US008889330B2

(12) United States Patent
Sugiura et al.

(10) Patent No.: US 8,889,330 B2
(45) Date of Patent: Nov. 18, 2014

(54) TONER, DEVELOPMENT AGENT, AND IMAGE FORMATION METHOD

(75) Inventors: Hideki Sugiura, Numazu (JP); Yuka Mizoguchi, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 241 days.

(21) Appl. No.: 12/912,099

(22) Filed: Oct. 26, 2010

(65) Prior Publication Data

US 2011/0097659 A1 Apr. 28, 2011

(30) Foreign Application Priority Data

Oct. 27, 2009 (JP) ..... 2009-246915
Nov. 4, 2009 (JP) ..... 2009-253097

(51) Int. Cl.
*G03G 9/093* (2006.01)
*G03G 15/00* (2006.01)
*G03G 9/08* (2006.01)

(52) U.S. Cl.
CPC ..... *G03G 9/0827* (2013.01); *G03G 9/09307* (2013.01); *G03G 15/6558* (2013.01); *G03G 9/0819* (2013.01); *G03G 9/0935* (2013.01); *G03G 9/09328* (2013.01); *G03G 9/09392* (2013.01)
USPC ..... 430/110.2; 430/110.1; 430/110.3; 430/110.4; 430/124.1

(58) Field of Classification Search
CPC ... G03G 9/093; G03G 9/035; G03G 9/09307; G03G 13/02; G03G 13/04; G03G 13/06; G03G 13/14; G03G 13/20
USPC ..... 430/110.2, 118.2, 137.17, 123.55, 430/124.1, 96, 97, 100–105, 106.1, 106.2, 430/106.3, 107.1, 108.1, 108.11, 108.14, 430/108.15, 108.2, 108.21, 108.22, 108.23, 430/108.24, 108.3, 108.4, 108.5, 108.6, 430/108.7, 108.8, 108.9, 109.1, 109.2, 430/109.3, 109.31, 109.4, 109.5, 110.1, 430/110.3, 110.4
See application file for complete search history.

(56) References Cited

U.S. PATENT DOCUMENTS 4,954,412 A * 9/1990 Breton et al. ..... 430/137.12
7,166,403 B2 1/2007 Ichikawa et al.

(Continued)

FOREIGN PATENT DOCUMENTS

JP 2004-310018 A 11/2004
JP 2005-24784 1/2005

(Continued)

OTHER PUBLICATIONS

Japanese Office Action issued Oct. 8, 2013, in Japan Patent Application No. 2009-253097.

(Continued)

*Primary Examiner* — Christopher Rodee
*Assistant Examiner* — Omar Kekia
(74) *Attorney, Agent, or Firm* — Oblon, Spivak, McClelland, Maier & Neustadt, L.L.P.

(57) ABSTRACT

A toner including a mother toner particle having a core-shell structure formed of a core containing a binder resin, a coloring agent, and an optional releasing agent, and a shell having a layer thickness of from 0.01 to 2.00 μm, the core having a softening index of from 60 to 85° C. as measured by a flow tester, and the shell having a thermal hardness of from 0.7 to 1.8 m, and an optional external additive.

17 Claims, 3 Drawing Sheets

(56) References Cited

U.S. PATENT DOCUMENTS

| | | | |
|---|---|---|---|
| 7,261,989 | B2 | 8/2007 | Sugiura et al. |
| 7,318,989 | B2 | 1/2008 | Kotsugai et al. |
| 7,368,212 | B2 | 5/2008 | Sugiura et al. |
| 7,374,851 | B2 | 5/2008 | Nakayama et al. |
| 7,455,942 | B2 | 11/2008 | Nagatomo et al. |
| 7,521,164 | B2 | 4/2009 | Nakayama et al. |
| 7,566,521 | B2 | 7/2009 | Kotsugai et al. |
| 7,608,377 | B2 | 10/2009 | Nakayama et al. |
| 7,642,032 | B2 | 1/2010 | Sugiura et al. |
| 7,664,439 | B2 | 2/2010 | Sugiura |
| 7,745,084 | B2 | 6/2010 | Sugiura et al. |
| 7,759,036 | B2 | 7/2010 | Utsumi et al. |
| 2005/0074685 | A1 | 4/2005 | Kido et al. |
| 2008/0305423 | A1 | 12/2008 | Sugiura et al. |
| 2009/0123186 | A1 | 5/2009 | Sugiura et al. |
| 2009/0142687 | A1 * | 6/2009 | Ariyoshi et al. ..... 430/109.4 |
| 2009/0220883 | A1 * | 9/2009 | Sugiura ..... 430/109.4 |

FOREIGN PATENT DOCUMENTS

| | | |
|---|---|---|
| JP | 2005-49437 | 2/2005 |
| JP | 2005-99083 | 4/2005 |
| JP | 2005-301261 A | 10/2005 |
| JP | 2006-267231 | 10/2006 |
| JP | 2007-108635 | 4/2007 |
| JP | 2008-275839 | 11/2008 |

OTHER PUBLICATIONS

Japanese Office Action issued Feb. 18, 2014 in Patent Application No. 2009-246915.

* cited by examiner

TONER, DEVELOPMENT AGENT, AND IMAGE FORMATION METHOD

BACKGROUND OF THE INVENTION

1. Field of the Invention

The present invention relates to a toner, a development agent, and an image formation method.

2. Discussion of the Background

Image forming apparatus employing electrophotography, electrostatic recording, or the like form images on an image bearing member that are developed with toner to obtain toner images. Then, these toner images are transferred onto a recording medium such as paper followed by fixing using heat to form images.

In addition, four colors of toner, namely black, yellow, magenta, and cyan, are used to form full color images. After each color toner image is transferred to and superimposed onto a recording medium to obtain a superimposed image, the superimposed image is fixed in place by heating.

Toner can be given a lower softening point to improve the low temperature fixing property, but in doing so high-temperature storage property of the toner deteriorates. In addition, development stability deteriorates due to spent toner on carriers and development members.

Japanese patent publication application no. 2006-267231-A describes a toner with a core-shell structure, having a releasing agent, a coloring agent, a binder resin, and a filler as toner for electrostatic image development. The toner has a half efflux temperature as measured by a flow tester of from 60 to 100° C. and the shell contains a thermoplastic resin.

However, a drawback of the above-described structure is that, even if fixing surface pressure is increased when images are fixed at low temperature, the releasing agent contained in the core is not sufficiently effused, resulting in the recording medium winding round the fixing device.

SUMMARY OF THE INVENTION

Accordingly, an object of the present invention is to provide an improved toner that has excellent low temperature fixing property, high-temperature storage, and development stability and prevents occurrence of winding of the recording medium during fixing even if the fixing surface pressure increases, a development agent containing the toner, and an image formation method using the development agent.

Briefly, this object and other objects of the present invention as hereinafter described will become more readily apparent and can be attained, either individually or in combination thereof, by a toner including a mother toner particle having a core-shell structure formed of a core containing a binder resin, a coloring agent, and an optional releasing agent, and a shell having a layer thickness of from 0.01 to 2.00 μm, the core having a softening index of from 60 to 85° C. as measured by a flow tester, and the shell having a thermal hardness of from 0.7 to 1.8 m, and an optional external additive.

It is preferred that, in the toner described above, the shell is formed of resin particulates.

It is still further preferred that, in the toner described above, the shell contains a crystalline polyester.

It is still further preferred that, in the toner described above, the mother particle is formed by emulsifying or dispersing in an aqueous medium a solution in which a toner material is dissolved or dispersed in an organic solvent.

It is still further preferred that, in the toner described above, the toner material contains a polyester prepolymer having an isocyanate group, and the mother toner particle is formed by conducting addition reaction of the polyester prepolymer and a compound having an amino group after emulsification or dispersion of the solution in the aqueous medium.

It is still further preferred that, in the toner described above, the aqueous medium contains resin particulates.

It is still further preferred that the toner described above has an average circularity of from 0.93 to 0.99.

It is still further preferred that the toner described above has a form factor SF-1 of from 100 to 150 and a form factor SF-2 of from 100 to 140.

It is still further preferred that the toner described above has a weight average particle diameter of from 2 to 7 μm, and a ratio of the weight average particle diameter to a number average particle diameter of from 1.00 to 1.25.

As another aspect of the present invention, a development agent is provided which includes the toner described above and a carrier.

As another aspect of the present invention, an image formation method is provided which includes forming a latent electrostatic image on an image bearing member, developing the latent electrostatic image with the development agent described above to form a toner image, transferring the toner image to a recording medium, and fixing the toner image transferred to the recording medium.

It is preferred that the method of image formation further includes pressing the recording medium to which the toner image is transferred with a surface pressure of from 10 to 150 $N/cm^2$, and wherein the system speed is of from 500 to $2.5\times10^3$ mm/s.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1A:
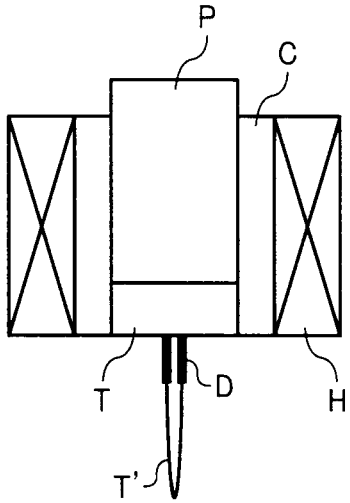
FIGS. 1A and 1B are diagrams illustrating a method of measuring the softening index of the core and the thermal hardness of the shell.

Next, embodiments of the present disclosure are described with reference to the accompanying drawings.

The toner of the present disclosure contains mother particles formed of a core-shell structure formed of a core containing a binder resin, a coloring agent, and an optional releasing agent, and a shell.

The softening index Ct of the core is from 60 to 85° C., and preferably from 63 to 77° C.

When the softening index Ct is too low, the high-temperature storage tends to deteriorate. When the softening index Ct is too high, the low temperature fixing property may deteriorate.

The softening index Ct is a temperature at which the toner starts to efflux under a load of 25 kg using a flow tester (CFT-500D, manufactured by Shimadzu Corporation).

That is, the softening index Ct is thought to represent the temperature at which the structure of the shell is broken under heavy load so that the toner starts to efflux.

The thermal hardness St of the shell is from 0.7 to 1.8 and preferably from 1.0 to 1.8.

When the thermal hardness St is too small, the high-temperature storage and the development stability tend to deteriorate. When thermal hardness St is too large, the low temperature fixing property tends to deteriorate so that the recording medium winds around the fixing device during fixing even if the fixing surface pressure increases.

The thermal hardness St is a product of −1 times the inclination of a graph with an X axis of load and Y axis of the efflux starting temperature of the toner measured when the toner starts to efflux under a load of from 2 to 25 kg using a flow tester (CFT-500D, manufactured by Shimadzu Corporation).

When the thermal hardness St is small, the efflux starting temperature does not rise even when the load is light.

That is, the structure of the shell is broken even with light load so that the toner easily becomes soft.

When thermal hardness St is large, the efflux starting temperature easily rises as the load decreases.

That is, the structure of the shell is hardly broken with light load so that the toner hardly becomes soft.

The flow tester (CFT CFT-500D, manufactured by Shimadzu Corporation) measures the descending amount of a plunger P to the temperature of a heating body H as follows: As illustrated in FIG. 1A, preliminarily heat a tablet toner T set in a cylinder C; raise the temperature of the heating body H while applying a constant amount of load to the toner T by the plunger P to make melted toner T' outflow from a die D; and measure the descending amount of the plunger P to the temperature of the heating body H.

In general, the flow tester (CFT-500D, manufactured by Shimadzu Corporation) is used to measure the efflux starting temperature $T_{fb}$ and the half temperature $T_{1/2}$. In the present disclosure, it is found that the thermal hardness St can be evaluated by measuring the efflux starting temperature $T_{fb}$ while changing the load.

The thermal hardness St shows the pressure dependency of the efflux starting temperature $T_{fb}$ of the toner.

The thickness of the shell of the toner is from 0.01 to 2 μm, and preferably from 0.4 to 1.5 μm. When the shell is too thin, the high-temperature storage and the development stability tend to deteriorate. When the shell is too thick, the low temperature fixing property tends to deteriorate, so that the recording medium winds around the fixing device during fixing even if the fixing surface pressure increases.

The thickness of the shell can be measured by a transmission electron microscope (TEM), a field-emission-type scanning electron microscope (FE-SEM), a scanning probe microscope (SPM), etc., and is the average of the shell thickness of randomly selected ten toner particles.

In the present disclosure, the shell preferably contains resin particulates.

If the resin particulates are contained in the shell, a uniform core-shell structure, and a core-shell structure having different softening temperatures for the core and the shell can be stably formed.

The glass transition temperature of the resin particulate is preferably from 40 to 100° C.

When the glass transition temperature is too low, the high-temperature storage of the toner may deteriorate. When the glass transition temperature is too high, the low temperature fixing property may deteriorate.

In addition, the weight average molecular weight of the resin particulate is preferably from $3\times10^3$ to $3\times10^5$.

When the weight average molecular weight is too small, the high-temperature storage tends to deteriorate. When the weight average molecular weight is too large, the low temperature fixing property tends to deteriorate.

The content of the resin particulate in the toner is preferably from 0.5 to 5.0% by weight.

When the content of the resin particulate is too small, the high-temperature storage and the development stability tend to deteriorate. When the content of the resin particulate is too thick, the low temperature fixing property tends to deteriorate so that the recording medium winds around the fixing device during fixing even if the fixing surface pressure increases.

The content of the resin particulate in the toner can be calculated by the peak area obtained by analyzing the material deriving from the resin particulate and not deriving from the material other than the resin particulate forming the toner by using a pyrolysis gas chromatography mass spectrometer.

There is no specific limit to selection of the resin forming the resin particles and any known thermoplastic resins and thermal curing resins can be used. Specific examples thereof include, but are not limited to, vinyl resins, polyurethane resins, epoxy resins, polyester resins, polyamide resins, polyimide resins, silicone resins, phenolic resins, melamine resins, urea resins, aniline resins, ionomer resins, and polycarbonate resins. These can be used alone or in combination. Among these resins, vinyl resins, polyurethane resins, epoxy resins, and polyester resins are preferably used because aqueous liquid dispersion of fine spherical particulates can be easily prepared.

Specific examples of the vinyl resins include, but are not limited to, styrene-(meth)acrylate copolymers, styrene-butadiene copolymers, (meth)acrylic acid-acrylate copolymers, styrene-acrylonitrile copolymers, styrene-maleic anhydride copolymers and styrene-(meth)acrylic acid copolymers. Among these, styrene-butyl methacrylate copolymers are particularly preferable.

In the present disclosure, crystalline polyesters can be used as the resin particulate.

By using crystalline polyesters as the resin particulate, a core shell structure containing the crystalline polyester in the shell can be made.

The shell protects the toner from effusing wax, pigment, poor charging component in the toner, which has an adverse impact on the charging characteristics, carriers, and spent on the development device.

The shell includes at least a crystalline polyester resin and other optional components.

A toner that is formed by the shell containing at least a crystalline polyester resin as the binder resin melts sharply to the heating temperature while sustaining sufficient high-temperature storage and pressure resistance storage of the surface of the toner. This is preferable.

In general, a low softening point of the shell portion of the core-shell structure tends to cause problems with the high-temperature storage, and the pressure resistance storage. However, sufficient high-temperature storage and pressure resistance storage are imparted to the toner using sharp melting characteristics of the crystalline polyester.

Evaluation of Crystalline Polyester Resin

Whether a polyester resin is crystalline or not can be evaluated by whether the crystalline peak is present according to X-ray diffraction method.

The device and the conditions for evaluation of the crystalline polyester are specified below:

X-ray diffraction (wide-angle X-ray diffraction device: RINT-TTRIII type, manufactured by Rigaku Corporation)

X ray source: CuKα line

Tube voltage-Tube current: 50 kV-300 mA

Step width: 0.02 deg.

Measuring range: 2 to 60°

Measuring speed: 5 deg./min

Slit: 0.5 deg.-0.15 mm-0.5 deg.

Diffraction line bent crystal monochrome meter

The resin particulate containing the crystalline polyester preferably has a glass transition temperature (Tg) of from 40 to 100° C., more preferably from 55 to 90° C., and furthermore preferably from 60 to 85° C.

The resin particulate containing the crystalline polyester preferably has a weight average molecular weight of from 2,000 to 300,000. When the glass transition temperature (Tg) is too low, and/or the weight average molecular weight is too small, the storage of the toner tends to deteriorate, which leads to occurrence of blocking during storage and/or in the development device.

To the contrary, when the glass transition temperature (Tg) is too high, and/or the weight average molecular weight is too large, the resin particulate easily inhibits the attachability between the recording medium and the toner, resulting in a rise in the lowest fixing temperature.

Measuring of Number Average Molecular Weight (Mn) and Weight Average Molecular Weight (Mw)

The number average molecular weight (Mn) and the weight average molecular weight (Mw) are measured by, for example, gel permeation chromatography (GPC).

The molecular weight measured by GPC is conducted by a measuring device (GPC•HLC-8120, manufactured by Tosoh Corporation) with a column (TSKgel SuperHM-M (15 cm), manufactured by Tosoh Corporation and a tetrahydrofuran solution.

The respective average molecular weights are calculated by using the molecular calibration curve made by the monodisperse polystyrene standard sample based on the measuring results.

In the present disclosure, the crystalline polyester resin represents a polyester resin in which crystalline areas and non-crystalline areas are mixed.

In the crystalline area, moleculars having long chains are regularly arranged in the molecular structures.

In the non-crystalline area, moleculars having long chains are randomly arranged in the molecular structures.

The crystalline polyester resin represents a polymer (including copolymer) formed by polymerization of a component constituting a polyester and other components as well as a polymer structured only by a polyester.

However, the polymer formed by polymerization of a component constituting a polyester and other components has the other components in an amount of 50% by weight or less.

In addition, the crystalline degree is not necessarily 100%. Any polyester resin that has a little crystalline degree demonstrates the performance described above. The crystalline degree is preferably from 10 to 100% and more preferably from 30 to 100%.

The crystalline polyester resin is synthesized by, for example, polycarboxylic acid component and polyalcohol component.

Any marketed product of crystalline polyester resin and any synthesized crystalline polyester resin can be suitably used as the crystalline polyester resin described above.

Specific examples of the polycarboxylic acids include, but are not limited to, aliphatic dicarboxylic acids such as oxalic acid, succinic acid, glutaric acid, adipic acid, acid, pimelic acid, suberic acid, azelaic acid, sebacic acid, 1,9-nonane dicarboxylic acid, 1,10-decane dicarboxylic acid, 1,12-dodecane dicarboxylic acid, 1,14-tetradecane dicarboxylic acid, and 1,18-octadecane dicarboxylic acid; aromatic dicarboxylic acids of dibasic acids such as phthalic acid, isophthalic acid, terephthalic acid, naphthalene-2,6-dicarboxylic acid, manoic acid, and mesaconic acid; and anhydrides or lower alkylesters thereof.

Specific examples of the tri- or higher carboxylic acids include, but are not limited to, 1,2,4-benzene tricarboxylic acid, 1,2,5-benzene tricarboxylic acid, 1,2,4-naphtalene tricarboxylic acid, and their anhydrides or lower alkyl esters.

These can be used alone or in combination.

In addition to the above-specified aliphatic dicarboxylic acids and the aromatic dicarboxylic acids, diacarboxylic acid components having sulfonate group can be suitably contained as the acid component in the polycarboxylic acid.

In addition to the above-specified aliphatic dicarboxylic acids and the aromatic dicarboxylic acids, diacarboxylic acid components having carbon-carbon double bond can be suitably contained as the carboxylic acid component in the polycarboxylic acid.

Aliphatic diols are preferable as the polyalcohol component. Straight chain aliphatic diols having 7 to 20 carbon atoms in the main chain portions are more preferable.

If the aliphatic diols are of a branch type, the crystalline level of the polyester resin decreases, resulting in a drop of the melting point.

In addition, when the number of carbon atoms in the main chain is too small in the case of polycondensation with the aromatic dicarboxylic acid, the melting temperature tends to drop, degrading the low temperature fixing difficult.

To the contrary, when the number of carbon atoms in the main chain is too large, practical materials tend to be unavailable.

The number of the carbon atoms in the main chain is preferably 14 or less.

Specific examples of the aliphatic diols suitably used in the synthesis of the crystalline polyester include, but are not limited to, ethylene glycol, 1,3-propane diol, 1,4-butane diol, 1,5-pentane diol, 1,6-hexane diol, 1,7 heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, and 1,14-eicosane diol.

Among these, in terms of availability, 1,8-octane diol, 1,9-nonane diol, and 1,10-decane diol are particularly preferable.

Specific examples of the alcohols having three or more hydroxyl groups include, but are not limited to, glycerin, trimethylol ethane, trimethylol propane, and pentaerythritol. These can be used alone or in combination.

Among the alcohol component, the content of the aliphatic diol is preferably 80 mol % or greater, and more preferably 90 mol % or greater.

When the content of the aliphatic diol is too small, the crystalline level tends to decrease, resulting in a drop in the melting point. Therefore, the toner blocking resistance, the image preservability, and the low temperature fixing property may deteriorate.

Polycarboxylic acids and/or polyalcohols can be optionally added in the last stage to adjust the acid value or the hydroxyl value, etc.

Specific examples of the polycarboxylic acids include, but are not limited to, aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and alicyclic carboxylic acids such as cyclohexane dicarboxylic acid.

Specific examples of the polyalcohols acids include, but are not limited to, aliphatic diols such as ethylene glycol, diethylene glycol, triethylene glycol, propylene glycol, butane diol, hexane diol, neopentyl glycol, and glycerin; alicyclic diols such as cyclohexane diol, cyclohexane dimethanol, and hydrogenated bisphenol A; and aromatic diols such as adducts of bisphenol A with ethylene oxide, and adducts of bisphenol A with propylene oxide.

The crystalline polyester resin can be manufactured at a polymerization temperature range of from 180 to 230° C. optionally under a reduced pressure to remove water and alcohol produced during condensation reaction.

When the polymerizable monomer is not dissolved or compatible in the reaction temperature range, a solvent having a high boiling point is added as a dissolution helping agent.

The polymerization condensation reaction is conducted while removing the dissolution helping agent.

When there is any polymerizable monomer that has a poor compatibility in the copolymerization reaction, the polymerizable monomer that has a poor compatibility is condensed first with the acid or alcohol planned to be polycondensed with the polymerizable monomer, and then polycondensed with the main component.

Specific examples of the catalysts used in manufacturing the polyester resin include, but are not limited to, alkali metal compounds such as sodium, and lithium; alkali earth metal compounds such as magnesium, and calcium; metal compounds such as zinc, manganese, antimony, titanium, tin, zirconium, and germanium; phosphorous acid compounds; phosphoric acid compounds; and amine compounds.

Specific examples of the catalysts include, but are not limited to, sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabuthoxide, anitimony trioxide, triphenyl antimony, tributyl antimoony, tin formate, tetraphenyl tin, dibutyltin dichloride, dibutyl tin oxide, diphenyl tin oxide, zirconium tetrabuthoxide, zirconium naphthenate, zirconil carbonate, zirconil acetate, zirconilstearate, zirconiloctylate, germanium oxide, triphenyl phosphate, tris(2,4-di-t-butylphenyl)phosphate, ethyltriphenyl phosphonium, bromide, triethylamine, and triphenyl amine.

The acid value (=mg of KOH required to neutralize 1 g of a resin) of the crystalline polyester resin is preferably from 3.0 to 30.0 mgKOH/g, more preferably from 6.0 to 25.0 mgKOH/g, and furthermore preferably from 8.0 to 20.0 mgKOH/g.

When the acid value is too small, the level of the dispersion property into the water easily drops so that granulation by the wet method is extremely difficult.

In addition, stability of the polymerization particles during agglomeration tends to sharply drop, which makes it extremely difficult so that the toner is not efficiently manufactured.

To the contrary, when the acid value is too large, moisture absorption of the toner tends to increase so that the obtained toner is susceptible to environmental change.

The crystalline resin containing the crystalline polyester resin preferably contains a crystalline polyester resin synthesized by an aliphatic polymerizable monomer as the main component, i.e., in an amount of 50% by weight.

The composition ratio of the aliphatic polymerizable monomer forming the crystalline resin containing the crystalline polyester resin is preferably from 60% or greater, and more preferably from 90 mol % of greater.

Specific examples of the aliphatic polymerizable monomers include, but are not limited to, aliphatic diols, and dicarboxyl acids.

The resin particulates containing at least the crystalline polyester resin are preferably manufactured by the following emulsification process.

When the resin particulates are used for the shell of the toner, the resin particulates are preferably used in the state of emulsified liquid dispersion.

In the emulsification process, at least one kind of crystalline resins and optionally at least one kind of non-crystalline polyester resins are heated to and melted at one of the higher temperature of the melting point and the glass transition temperature of the resin, and at the temperature equal to or lower than the boiling point of the used organic solvent to obtain a uniform solution; Basic aqueous solution is added as the neutralization reagent; impart stirring and shearing force to the resultant while adding pure water to control pH of the resultant from 7 to 9 to transfer the phase; thus, an emulsion of O/W type of the resin is obtained.

Then, the solvent is removed by evaporating the obtained emulsion with a reduced pressure to obtain an emulsion of resin particles.

pH after neutralization is from 7 to 9, and preferably from 7 to 8. Specific examples of the usable basic aqueous solution include, but are not limited to, hydroxides of alkali metals such as ammonium aqueous solution, sodium hydroxide, and potassium hydroxide.

A pH that is too low tends to cause a problem that coarse particles tend to be formed in the emulsion. A pH that is too high tends to cause a problem that the agglomerated particle size formed in the next process of agglomeration increases.

When particles in which the crystalline polyester resin and the non-crystal polyester resin are compatible are used, the releasing agent particles tend to agglomerate with the resin particle portion having a low acid value. Therefore, the toner having the core-shell structure of the present disclosure is obtained.

The average particle diameter of the resin particles are preferably 1,000 nm or smaller, more preferably from 10 to 1,000 nm, furthermore preferably from 10 to 800 nm, and particularly preferably from 100 to 500 nm.

When the average particle diameter is too large, the particle size distribution of the finally obtained toner tends to be not stably controlled so that isolated particles are produced, causing degradation of the performance and the reliability. When the average particle diameter is too small, the toner may not be formed.

The average particle diameter is measured by a laser scattering particle size distribution analyzer (LA-920, manufactured by Horiba Ltd.).

Aqueous medium, and organic medium can be used as the dispersion solvent in the liquid dispersion.

Specific examples of the aqueous media include, but are not limited to, water such as distilled water and de-ionized water, alcohols, acetates, ketones and mixtures thereof. These can be used alone or in combination.

A surface active agent can be admixed in the aqueous medium.

Specific examples of the active surface agent include, but are not limited to, anion surface active agents such as sulfuric acid ester salts, sulfonic acid salts, phosphoric acid salts, and soap based active agents; cation active surface agents such as amine salt type, and quaternary ammonium salt type; non-ion based active agents such as polyethylene glycols, adducts of alkylphenol ethylene oxides, and polyalcohols.

Among these, anion surface active agents and cation surface active agents are preferred.

The non-ion based surface active agents is preferably used in combination with the anion surface active agents or cation surface active agents.

These surface active agents can be used alone or in combination.

Specific examples of the anion surface active agents include, but are not limited to, dodecyl benzene sodium sulfonate, dodecyl sodium sulfate, alkyl naphthalene sodium sulfonate, and dialkyl sodium sulfosuccinate.

In addition, the specific examples of the anion surface active agents include, but are not limited to, alkylbenzene methyl ammonium chloride, alkyl trimethylammonium chloride, and distearyl ammonium chloride.

Among these, ion surface active agents such as anion surface active agents and cation surface active agents are particularly preferred.

Specific examples of the organic solvents include, but are not limited to, ethyl acetate, methyl ethyl ketone, acetone, toluene, and alcohols such as isopropyl alcohol. This organic solvent is selected depending on the selection of the binder resin described above.

When the resin particulates are the crystalline polyester resins and the non-polyester resins, the resin particulates have a functional group that can be anion type by neutralization, and self-water-dispersion property. The resin particulates form a self-water-dispersion body in which part or all of the functional groups that can be hydrophilic is neutralized by a base and is stable under the function of the aqueous medium.

Since the functional group that can be hydrophilic by neutralization in the crystalline polyester resin or amorphous polyester resins is an acid group such as carboxyl group and sulfone group, specific examples of the neutralization reagent include, but are not limited to, inorganic bases such as sodium hydroxide, potassium hydroxide, lithium hydroxide, calcium hydroxide, sodium carbonate, and ammonia, organic bases such as diethylamine, triethylamine, and isopropyl amine.

In addition, when a polyester resin that is not dispersed in water, i.e., has no self-water dispersibility, is used as the binder resin, similar to the releasing agents described later, particles having a diameter of 1 μm or smaller can easily be obtained by dispersing the binder resin, an ionic surface active agent, polymer electrolyte, a polymer acid, a polymer base in the resin solution, and/or the aqueous medium to be mixed with the resin solution, heating the liquid dispersion to a temperature equal to or higher than the melting point, and processing the liquid dispersion with a Homogenizer, or a pressure discharging type disperser that can apply a strong shearing force.

When the ionic surface active agent and/or the polymer electrolyte are used, the density thereof in the aqueous medium can be controlled to be from about 0.5 to 5% by weight.

In the present disclosure, the binder resin preferably has a polyester resin and/or a urea-modified polyester.

The low temperature fixing property and the gloss and gloss uniformity of an image output by a full color image forming apparatus can be improved by using a combination of the polyester and the urea-modified polyester.

In addition, the binder resin may contain other modified polyesters such as a urethane polyester other than the urea-modified polyester.

The polyester is obtained by heating the polyol (1) and the polycarboxylic acid (2) to 150 to 280° C. under the presence of known catalysts such as tetrabutoxy titanate, dibutyl tin oxide, etc.; and removing produced water with a reduced pressure, if necessary, for polycondensation.

Specific examples of the polyol (1) include, but are not limited to, diol (1-1), polyols (tri- or higher polyol) (1-2) and using diol (1-1) or a combinational use of diol (1-1) with polyol (1-2) is preferable.

Specific examples of the diols (1-1) include, but are not limited to, alkylene glycols such as ethylene glycol, 1,2-propylene glycol, 1,3-propylene glycol, 1,4-butanediol and 1,6-hexanediol; alkylene ether glycols such as diethylene glycol, triethylene glycol, dipropylene glycol, polyethylene glycol, polypropylene glycol and polytetramethylene ether glycol; alicyclic diols such as 1,4-cyclohexane dimethanol and hydrogenated bisphenol A; adducts of alicyclic diols with an alkylene oxide such as ethylene oxide, propylene oxide, and butylene oxide; bisphenols such as bisphenol A, bisphenol F, and bisphenol S; and adducts of bisphenols or aliphatic diols with an alkylene oxide such as ethylene oxide, propylene oxide, and butylene oxide.

Among these, an alkylene glycol or an adduct of a bisphenol with an alkylene oxide having 2 to 12 carbon atoms are preferable. An adduct of a bisphenol with an alkylene oxide and a combinational use of an adduct of a bisphenol with an alkylene oxide and an alkylene glycol having a 2 to 12 carbon atoms are particularly preferable.

Specific examples of the polyols (1-2) having three or more alcohol groups include, but are not limited to, glycerin, trimethylol ethane, trimethylol propane, pentaerythritol and sorbitol); polyphenols having three or more phenolic groups (trisphenol PA, phenol novolak and cresol novolak); and adducts of the polyphenols having three or more alcohol groups with an alkylene oxide such as ethylene oxide, propylene oxide, and butylene oxide. These can be used alone or in combination.

Specific examples of suitable polycarboxylic acids (2) include, but are not limited to, dicarboxylic acids (2-1) and polycarboxylic acids (2-2) having three or more carboxyl groups. Among these, using the dicarboxylic acid (2-1) alone or a mixture of the dicarboxylic acid (2-1) and polycarboxylic acid (2-2) is preferable.

Specific examples of the dicarboxylic acids (2-1) include, but are not limited to, alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid, naphthalene dicarboxylic acids; etc.). These can be used alone or in combination.

Among these compounds, alkenylene dicarboxylic acids having from 4 to 20 carbon atoms and aromatic dicarboxylic acids having from 8 to 20 carbon atoms are preferably used.

Specific examples of the polycarboxylic acids (2-2) having three or more hydroxyl groups include, but are not limited to, aromatic polycarboxylic acids having 9 to 20 carbon atoms (e.g., trimellitic acid and pyromellitic acid).

In addition, instead of polycarboxylic acid (2), anhydrides of polycarboxylic acid (2) or lower alkyl esters (e.g., methyl esters, ethyl esters or isopropyl esters) can be used.

The polyester has a peak molecular weight of from $1\times10^3$ to $3\times10^4$, preferably from $1.5\times10^3$ to $1\times10^4$, and more preferably from $2\times10^3$ to $8\times10^3$. When the peak molecular weight is too small, the high-temperature storage tends to deteriorate.

When the peak molecular weight is too large, the low temperature fixing property tends to deteriorate.

In the present disclosure, the peak molecular weight is a molecular weight in conversion of polystyrene measured by using gel permeation chromatography (GPC).

The polyester has a hydroxyl value of 5 mgKOH/g or greater, preferably from 10 to 120 mgKOH/g, and more preferably from 20 to 80 mgKOH/g.

A hydroxyl value that is too small may be disadvantageous in terms of having a good combination of the high-temperature storage and the low temperature fixing property.

In the present disclosure, the hydroxyl group can be measured according to the measuring method described in JIS K 1557-1.

The acid value of the polyester is from 0.5 to 40 mgKOH/g and preferably 5 to 35 mgKOH/g.

An acid value that is too small tends to make negative charging difficult.

When the acid value is too large, the obtained toner tends to be susceptible to the environmental change in a high temperature and high moisture environment or in a low temperature and low moisture environment, resulting in deterioration of the image quality.

In the present disclosure, the acid value can be measured according to the measuring method described in JIS K0070-1992.

In the present disclosure, the urea-modified polyester can be obtained by conducting addition reaction of a polyester prepolymer (A) having an isocyanate group and a compound (B) having an amino group.

In addition, the polyester prepolymer (A) having an isocyanate group is obtained by conducting addition reaction of a polyester having an active hydrogen group and a polyisocyanate (3) at 40 to 140° C.

Specific examples of the active hydrogen group include, but are not limited to, hydroxyl groups (alcohol hydroxyl groups and phenol hydroxyl groups), amino groups, carboxyl groups, and mercarpto groups. Among these, alcohol hydroxyl group is preferable.

As the active hydrogen group, the polyester having an alcohol hydroxyl group is obtained by polycondensing the polyol (1) and the polycarboxylic acid (2).

The equivalent ratio of the alcohol hydroxyl group to carboxyl group is from 1 to 2, preferably from 1 to 1.5 and more preferably from 1.02 to 1.3.

Specific examples of the polyisocyanates (3) include, but are not limited to, aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisosycantes (e.g., tolylene diisocyanate and diphenylmethane diisocyanate); aromatic aliphatic diisocyanates (e.g., α,α,α',α'-tetramethyl xylylene diisocyanate); isocyanurates. These compounds can be used alone or in combination.

In addition, instead of the polyisocyanate (3), blocked polyisocyanates in which the polyisocyanates (3) are blocked with phenol derivatives, oximes or caprolactams etc. are suitably used.

When the polyester prepolymer (A) having an active hydrogen group is reacted with the polyisocyanates (3) (addition reaction), the equivalent ratio of the isocyanate group to the alcohol hydroxyl group is from 1 to 5, preferably from 1.2 to 4, and more preferably from 1.5 to 2.5. When the equivalent ratio is too small, the content of the urea linkage in the urea-modified polyester decreases, which may lead to deterioration of hot offset resistance. When the equivalent ratio is too large, the low temperature fixing property tends to deteriorate.

The content of the composition deriving from the polyisocyanate (3) in the polyester prepolymer (A) having an isocyanate group is from 0.5 to 40% by weight, preferably from 1 to 30% by weight, and more preferably from 2 to 20% by weight.

A content that is too small may cause degradation of the hot offset resistance of the toner. By contrast, when the content is too high, the low temperature fixing property of the toner easily deteriorates.

The average content of the isocyanate group per molecule of the polyester prepolymer (A) having an isocyanate group is one group or greater, preferably from 1.5 to 3 groups, and more preferably from 1.8 to 2.5 groups. When the average content is too small, the molecular weight of a urea-modified polyester resin decreases, which may cause deterioration of the hot offset resistance.

Specific examples of the compound (B) having an amino group include, but are not limited to, diamines (B1), polyamines (B2) having three or more amino groups, amino alcohols (B3), amino mercaptans (B4), and amino acids (B5). Among these, diamine (B1) or a combinational use of diamine (B1) with polyamines (B2) is preferable.

Specific examples of the diamines (B1) include, but are not limited to, aromatic diamines (e.g., phenylene diamine, diethyltoluene diamine, and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine, and hexamethylene diamine); etc. These can be used alone or in combination.

Specific examples of the polyamines (B2) having three or more amino groups include, but are not limited to, diethylene triamine, and triethylene tetramine. These can be used alone or in combination.

Specific examples of the amino alcohols (B3) include, but are not limited to, ethanol amine and hydroxyethyl aniline. These can be used alone or in combination.

Specific examples of the amino mercaptan (B4) include, but are not limited to, aminoethyl mercaptan and aminopropyl mercaptan. These can be used alone or in combination.

Specific examples of the amino acids (B5) include, but are not limited to, amino propionic acid and amino caproic acid. These can be used alone or in combination.

In addition, in place of the compound (B) having an amino group, blocked compounds in which the amino group in the compound (B) having an amino group can be used.

Specific examples of the blocked compounds in which the amino group in the compound (B) having an amino group include, but are not limited to, ketimine compounds or oxazoline compounds which are prepared by reacting the compound (B) having an amino group with a ketone such as acetone, methyl ethyl ketone and methyl isobutyl ketone.

When the polyester prepolymer (A) having an isocyanate group is reacted with the compound (B) having an amino group (addition reaction), catalysts such as dibutyl tin laurate, and dioctyl laurate can be suitably used.

The reaction time is from 10 minutes to 40 hours, and preferably from 2 to 24 hours.

In addition, the reaction temperature is from 0 to 150° C., and preferably from 40 to 98° C.

When the polyester prepolymer (A) having an isocyanate group is reacted with compound (B) having an amino group, the equivalent ratio of the isocyanate group to the amine group is from 0.5 to 2, preferably from ⅔ to 1.5, and more preferably from ⅚ to 1.2.

When the equivalent ratio is too small, the molecular weight of the urea-modified polyester resin decreases, which may lead to deterioration of hot offset resistance.

Furthermore, the molecular weight of the urea-modified polyesters can be adjusted by using a molecular weight control agent.

Specific examples of the molecular weight control agent include, but are not limited to, monoamines (e.g., diethyl amine, dibutyl amine, butyl amine and lauryl amine), and blocked amines (e.g., ketimine compounds) prepared by blocking a monoamine with a ketone.

Specific examples of the blocked amines in which the amino group of the monoamine is blocked include, but are not limited to, ketimine compounds and oxazoline compounds which are prepared by reacting the monoamine with a ketone such as acetone, methyl ethyl ketone and methyl isobutyl ketone.

The urea-modified polyester and the polyester are preferably at least partially compatible with each other. That is, it is preferable that the polyester component in the urea-modified polyester is similar to the composition of the polyester.

Due to this, the low temperature fixing property and hot offset resistance are improved.

The weight ratio of the polyester (C) to the urea-modified polyester is from 5/95 to 75/25, preferably from 10/90 to 25/75, more preferably from 12/88 to 25/75 and particularly preferably from 12/88 to 22/78. A content ratio that is too low may degrade the hot offset resistance of the toner. By contrast, when the content ratio is too high, the low temperature fixing property of the toner easily deteriorates.

Any known releasing agent can be suitably used. Specific examples of the release agent (wax) include, but are not limited to, polyolefin waxes such as polyethylene waxes and polypropylene waxes; long chain hydrocarbons such as paraffin waxes and SAZOL waxes; waxes including a carbonyl group, etc. These can be used alone or in combination. Among these waxes, the waxes including a carbonyl group are preferable.

Specific examples of the waxes including a carbonyl group include, but are not limited to, polyalkane acid esters such as carnauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters such as trimellitic acid tristearyl, and distearyl maleate; polyalkane acid amides such as ethylene diamine dibehebylamide; polyalkylamide such as trimellitic acid tristearylamide; dialkyl ketone such as distearyl ketone, etc. Among these, polyalkane acid esters are preferable.

The melting point of the releasing agent is from 40 to 160° C., more preferably from 50 to 120° C., and particularly preferably from 60 to 90° C. When the melting point of the releasing agent is too low, the high-temperature storage of the toner tends to deteriorate. By contrast, when the melting point is too high, a cold offset problem, i.e., an offset phenomenon that occurs at a low fixing temperature, tends to occur.

The releasing agent preferably has a melt viscosity of from 5 to 1,000 cps and more preferably from 10 to 100 cps at a temperature 20° C. higher than the melting point of the releasing agent.

A melt viscosity that is too low may cause degradation of the dispersion property of the releasing agent in the mother toner particles. By contrast, a melt viscosity that is too high may cause degradation of the hot offset resistance and the low temperature fixing property of the toner.

The content of the releasing agent in the toner is from 0 to 40% by weight and preferably from 3 to 30% by weight.

In the present disclosure, the core optionally contains a releasing agent and a charge control agent.

Specific examples of the coloring agents for use in the toner of the present disclosure include, but are not limited to, known dyes and pigments such as carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red FSR, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination.

The content of the coloring agent in the toner is from 1 to 15% by weight and preferably from 3 to 10% by weight.

The pigment and the resin can be used in combination as a master batch.

Specific examples of the resins for use in the master batch include, but are not limited to, the polyester resins and the urea-modified polyester resins described above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins can be used alone or in combination.

The master batch can be obtained by mixing, and kneading the pigment and the resin by application of a high shearing force.

An organic solvent can be used to improve the mutual interaction between the resin and the pigment.

In addition, the master batch is also obtained by mixing and kneading an aqueous paste of the pigment with the resin and the organic solvent to transfer the pigment to the resin side followed by removal of fluid and the organic solvent (flushing method).

At this point, the wet cake of the pigment can be used as is, it is not necessary to dry the pigment.

In this case, a high shearing dispersion device such as a three-roll mill, etc. can be preferably used for mixing and kneading.

Any known charge control agent can be used. Specific examples thereof include, but are not limited to, nigrosine dyes, triphenylmethane dyes, chrome containing metal complex dyes, chelate pigments of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing surface active agents, metal salts of salicylic acid, copper phthalocyanine, perylene, metal salts of salicylic acid derivatives, quinacridone, and azo-based pigments.

Specific examples of the other charge control agents include, but are not limited to, polymers having a functional group such as a sulfonate group, a carboxyl group, or a quaternary ammonium group.

Specific examples of the marketed products of the charge control agents include, but are not limited to, BONTRON 03 (nigrosine dye), BONTRON P-51 (quaternary ammonium salt), BONTRON S-34 (azo dyes containing metal), E-82 (metal complex of oxynaphthoic acid), E-84 (metal complex of salicylic acid), and E-89 (phenolic condensation product), all of which are manufactured by Orient Chemical Industries Co., Ltd.; TP-302 and TP-415 (molybdenum complex of quaternary ammonium salts), which are manufactured by Hodogaya Chemical Co., Ltd.; COPY CHARGE PSY VP2038 (quaternary ammonium salt), COPY BLUE PR (triphenyl methane derivative), COPY CHARGE NEG VP2036 and NX VP434 (quaternary ammonium salt), all of which are manufactured by Hoechst AG; LRA-901, and LR-147 (boron complex), which are manufactured by Japan Carlit Co., Ltd.

The content of the charge control agent in the toner is preferably from 0.1 to 10% by weight, and more preferably from 0.2 to 5% by weight.

When the content is too large, the charging of the toner tends to increase, thereby increasing the electrostatic attractive force with the development roller, decreasing the fluidity of the toner, or decreasing the image density.

In the present disclosure, the mother particle can be formed by dissolving or dispersing a toner material containing the polyester prepolymer (A) having an isocyanate group, the coloring agent and the optional releasing agent in an organic solvent, then emulsifying or dispersing the organic liquid in an aqueous medium, and reacting the polyester prepolymer (A) having an isocyanate group with the compound (B) having an amino group.

The toner material optionally contains a polyester, and a charge control agent, etc.

There is no specific limit to the selection of the aqueous media. Water, and a mixture of water with a solvent mixable with water are suitable.

Specific examples of such solvents mixable with water include, but are not limited to, alcohols (e.g., methanol, isopropanol and ethylene glycol), dimethylformamide, tetrahydrofuran, cellosolves (e.g., methyl cellosolve), lower ketones (e.g., acetone and methyl ethyl ketone). These can be used alone or in combination.

In the present disclosure, the aqueous medium preferably contains resin particulates. Thus, the mother particle having a structure of the core-shell structure formed of the core containing the urea-modified polyester, the coloring agent and the optional releasing agent and the shell containing resin particles is obtained.

When the liquid in which the toner material is dissolved or dispersed in the organic solvent is emulsified or dispersed in the aqueous medium, a low speed shearing dispersion device, a high speed shearing dispersion device, a friction dispersion device, a high pressure jet dispersion device, an ultrasonic dispersion device are suitably used. Among these, a high speed shearing dispersion device is preferable.

When a high speed shearing type dispersion machine is used, the rotation speed is from 1,000 to 30,000 rpm, and preferably from 5,000 to 20,000 rpm.

The dispersion time is from 0.1 to 5 minutes in the batch system.

In addition, the temperature during dispersion is from 0 to 150° C., and preferably from 40 to 98° C. under pressure.

As the temperature rises, the viscosity of the aqueous solution formed by dissolving or dispersing the toner material in the organic solvent followed by emulsification or dispersion of the obtained liquid in the aqueous medium decreases, thereby making dispersion easier.

The toner material other than the polyester prepolymer (A) having an isocyanate group and the releasing agent can be added or mixed when the liquid in which the toner material is dissolved or dispersed in the organic solvent is emulsified or dispersed in the aqueous medium.

The toner material other than the polyester prepolymer (A) having an isocyanate group, the compound (B) having an amino group and the releasing agent can be added after the addition reaction of the polyester prepolymer (A) having an isocyanate group, and the compound (B) having an amino group.

For example, a coloring agent can be added according to a known dying method using a toner material without a coloring agent.

The weight ratio of the aqueous medium to the toner material is from 0.5 to 20, and preferably from 1 to 10.

When the weight ratio of the aqueous medium is too small, the dispersion of the toner material in the aqueous medium tend to be not satisfactory. Consequently, the resultant mother toner particles having desired particle diameters may not obtained. By contrast, a ratio of the aqueous medium that is too large is not preferable in terms of the economy.

The aqueous medium may contain a dispersion agent.

When the aqueous medium contains a dispersion agent, the aqueous solution formed by dissolving or dispersing the toner material in the organic solvent followed by emulsification or dispersion of the obtained liquid in the aqueous medium can be improved and a sharp particle size distribution can be obtained.

A surface active agent and an inorganic dispersion agent can be used as the dispersion agent.

There is no specific limit to the selection of the surface active agent. Specific examples of the surface active agents include, but are not limited to, anionic surface active agents such as alkylbenzene sulfonic acid salts, α-olefin sulfonic acid salts, and phosphoric esters; cationic surface active agents of amine salts (e.g., alkyl amine salts, aminoalcohol fatty acid derivatives, polyamine fatty acid derivatives and imidazoline); cationic surface active agents of quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surface active agents such as fatty acid amide derivatives, polyhydric alcohol derivatives; and ampholytic surface active agents such as alanine, dodecylbis(aminoethyl)glycin, bis(octylaminoethyl-e)glycin, and N-alkyl-N,N-dimethylammonium betaine. Among these, surface active agents having fluoroalkyl groups are preferable because the addition amount thereof is extremely small.

Specific examples of the anionic surface active agents having a fluoroalkyl group include, but are not limited to, fluoroalkyl carboxylic acids having from 2 to 10 carbon atoms and their metal salts, disodium perfluorooctanesulfonylglutamate, sodium 3-{ω-fluoroalkyl(C6-C11)oxy}-1-alkyl (C3-C4) sulfonate, sodium 3-{ω-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl (C6-C10)-N-ethylsulfonyl glycin, monoperfluoroalkyl(C6-C16)ethylphosphates, etc.

Specific examples of the marketed products of such anionic surface active agents having a fluoroalkyl group include, but are not limited to, SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; and FUTARGENT F-100 and F150 manufactured by Neos Company limited.

Specific examples of the anionic surface active agents having a fluoroalkyl group include, but are not limited to, primary and secondary aliphatic amino acids, secondary amino acids, aliphatic quaternary ammonium salts (for example, perfluoroalkyl(C6-C10)sulfoneamidepropyltrimethyl ammonium salts), benzalkonium salts, benzetonium chloride, pyridinium salts, and imidazolinium salts.

Specific examples of the marketed products of the anionic surface active agents having a fluoroalkyl group include, but are not limited to, SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); and FUTARGENT F-300 (from Neos).

Specific examples of the inorganic dispersion agents include, but are not limited to, tricalcium phosphate, calcium carbonate, titanium oxide, colloidal silica, and hydroxyapatite.

Mother toner particles having a dispersion agent remaining on the surface of the toner particle can be used. However, it is preferable to wash and remove the dispersion agent in terms of the charging property of the toner particles. When a compound soluble in an acid and an alkali such as calcium phosphate is selected as the dispersion agent, calcium phosphate can be removed from the mother toner particles by dissolving the compound by using an acid such as hydrochloric acid followed by washing with water.

In addition, calcium phosphate can be removed from the mother particles by decomposition according to a zymolytic method.

The aqueous medium may contain a polymer protection colloid.

Specific examples of such polymeric protection colloids include, but are not limited to, polymers and copolymers prepared using monomers, for example, acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethylmethacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or a heterocyclic ring having a nitrogen atom (e.g., vinyl pyridine, vinyl pyrrolidone, vinyl imidazole and ethylene imine).

Specific examples of other polymeric protective colloids include, but are not limited to, polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds, for example, methyl cellulose, hydroxyethyl cellulose and hydroxypropyl cellulose.

In the present disclosure, the organic solvent is removed after dissolving or dispersing the toner material in the organic solvent followed by emulsification or dispersion of the obtained toner material liquid in the aqueous medium.

The organic solvent can be removed by, for example, a method of evaporating the organic solvent by a rotary evaporator, etc.

After removing the organic solvent, coarse particles are removed by an centrifugal. Subsequent to washing in a washing tank, the resultant material is dried by a blow-dryer. Mother toner particles are obtained by repeating this procedure.

Also, the organic solvent can be removed by using a spray dryer, a belt dryer, a rotary kiln, or the like to spray the aqueous solution formed by dissolving or dispersing the toner material in the organic solvent followed by emulsification or dispersion of the obtained liquid in the aqueous medium into a dry atmosphere to evaporate the organic solvent and the aqueous medium.

There is no specific limit to selection of the dry atmosphere.

Specific examples thereof include, but are not limited to, gases of air, nitrogen, carbon dioxide, or combustion gas that is heated to a temperature higher than the boiling point of the organic solvent and the aqueous medium.

Next, it is preferable to age the obtained mother particles. By aging, the hollow state inside the mother particle can be controlled.

The aging temperature is from 30 to 55° C., and preferably from 40 to 50° C.

The aging time is from 5 to 36 hours, and preferably from 10 to 24 hours.

When the particle size distribution of the mother toner particles is wide, the particle size distribution can be narrowed by classification using a cyclone, a decanter or a centrifugal.

Such mother toner particles can be used as the toner of the present disclosure, but it is preferable to use as the toner a mixture of the mother toner particles and an external additive such as a fluidizer mixed by a HENSCHEL MIXER, etc. because such external additives are suitable to assist improvement of the fluidity, the development property, the charging property of the toner.

The toner of the present disclosure can be obtained by removing coarse particles with ultrasonic screening, etc.

Specific examples of such fluidizers include, but are not limited to, inorganic particles, and hydrophobized inorganic particles. These can be used alone or in combination.

The fluidizer preferably contains hydrophobized inorganic particles having a primary particle average particle diameter of from 1 to 100 nm, more preferably from 5 to 70 nm, and particularly preferably a combination of hydrophobized inorganic particles having a primary particle average particle diameter of 20 nm or less and hydrophobized inorganic particles having a primary particle average particle diameter of 30 nm or greater.

In addition, it is preferable that the specific surface area of the fluidizers measured by the BET method is from 20 to 500 $m^2/g$.

The inorganic particles preferably has a primary particle average particle diameter of from 3 to 70 nm.

When the primary particle average particle diameter is too small, the inorganic particles may be embedded in the mother particle. When the primary particle average particle diameter is too large, the toner may damage the surface of the image bearing member when developed with the toner.

Specific examples of such inorganic particles include, but are not limited to, silica, alumina, titania, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. These can be used alone or in combination. Among these, silica and titania are preferable.

Specific examples of the marketed products of the silica particles include, but are not limited to, HDK H 2000, HDK H 2000/4, HDK H 2050 EP, HVK21, HDK H 1303, (all manufactured by Hoechst AG), R972, R974, RX200, RY200, R202, R805, and R812 (manufactured by Nippon Aerosil Co., Ltd.)

Specific examples of the marketed products of titania include, but are not limited to, P-25 (manufactured by Nippon Aerosil Co., Ltd.), STT-30, STT-65C-S (manufactured by Titan Kogyo, Ltd.), TAF-140 (manufactured by FUJI TITANIUM INDUSTRY CO., LTD.), MT-150W, MT-500B, MT-600B, and MT-150A (manufactured by Tayca Corporation).

Degradation of the fluidity and the chargeability of the toner can be reduced even in a high moisture environment by hydrophobization of the inorganic particles.

Specific examples of the hydrophobizing agents include, but are not limited to, silane coupling agents such as methyltrimethoxy silane, methytriethoxy silane, and octyl trimethoxy silane, sililization agent, silane coupling agents having an alkyl fluoride group, organic titanate coupling agents, aluminum containing coupling agents, and silicone oils.

Specific examples of the silicone oils include, but are not limited to, dimethyl silicone oil, methylphenyl silicone oil, chlorophenyl silicone oil, methylhydrogene silicone oil, alkyl-modified silicone oil, fluorine-modified silicone oil, polyether-modified silicone oil, alcohol-modified silicone oil, amino-modified silicone oil, epoxy-modified silicone oil, epoxy/polyether silicone oil, phenol-modified silicone oil, carboxyl-modified silicone oil, mercapto-modified silicone oil, (meth)acryl-modified silicone oil, and α-methylstyrene-modified silicone oil.

Specific examples of the hydrophobized titania particles include, but are not limited to, T-805 (manufactured by Nippon Aerosil Co., Ltd.), STT-30A, STT-65C-S (manufactured by Titan Kogyo, Ltd.), TAF-500T, TAF-1500T (manufactured by FUJI TITANIUM INDUSTRY CO., LTD.), MT-100S, MT-100T (manufactured by Tayca Corporation). and IT-S (manufactured by ISHIHARA SANGYO KAISHA, LTD.)

The content of the fluidizer in the toner is from 0.1 to 5% by weight and preferably from 0.3 to 3% by weight.

In the present disclosure, when the fluidizer and the mother particles are mixed, a cleaning property improver can be added to remove the toner remaining on the image bearing member, or a primary transfer medium after transfer of the toner.

Any known cleaning property improver can be suitably used. Specific examples thereof include, but are not limited to, aliphatic metal salts such as zinc stearate, aluminum stearate, and calcium stearate; resin particles of polycondensation resin, thermocuring resins, etc. such as polystyrene, (meth) acrylic acid ester copolymers, silicone resins, benzoguanamine, and nylon.

The resin particles can be manufactured by a soap free emulsification polymerization, suspension polymerization, dispersion polymerization, etc. Such resin particles preferably has a relatively sharp particle size distribution with a volume average particle diameter of from 0.01 to 1 μm.

The toner of the present disclosure preferably has an average circularity of 0.93 to 0.99. When the average circularity is too small, the form of the toner is too distant from a sphere so that the transferability deteriorates, resulting in degradation of the image quality.

In addition, when the average circularity is too large, the cleaning performance for the image bearing member or the transfer belt tends to deteriorate, which leads to contamination on produced images.

The average circularity of the toner is the average of the circularity defined by the following relationship:

Circularity=(length of the circumference of a circle having the same area as that of the projected image of a toner particle)/(length of the circumference of the projected image of the toner particle)

The average circularity is calculated by measuring toner particles by a flow type particle size analyzer (FPIA-2100, manufactured by Sysmex Corporation) followed by analysis using a analysis software (FPIA-2100 Data Processing Program for FPIA version 00-10).

The toner of the present disclosure preferably has a shape factor SF-1 of from 100 to 150.

When SF-1 is excessively large, the shape of the toner particles tends to be irregular so that the moving of the toner particles during transfer is not smooth and the behavior of the toner particles varies. Therefore, the transfer efficiency tends to below.

Furthermore, the charging of the toner particles is not stable and the toner particles themselves tend to be brittle.

As a result, the toner particles become fine powder in the development agent, meaning degradation of the durability of the development agent.

The toner of the present disclosure preferably has a shape factor SF-2 of from 100 to 140.

When the SF-2 is excessively large, the transferability tends to be insufficient.

SF-1 and SF-2 are represented by the following relationships:

$$SF\text{-}1=(L2/A)\times(\pi/4)\times100$$

$$SF\text{-}2=(P2/A)\times(1/4\pi)\times100$$

In the relationships, L represents the maximum length in absolute value of the toner particle, A represents the projected area of the toner, and P represents the maximum circumference length.

A true sphere has both a SF-1 and SF-2 of 100. As the value increases, the shape is away from the sphere and becomes irregular.

In addition, SF-1 is a shape factor representing the entire shape (e.g., ellipse, sphere, etc.), and SF-2 is a shape factor representing the levels of roughness (concave-convex) of the surface.

Furthermore, SF-1 and SF-2 are calculated by sampling 300 particles at random from photographs shot by a field emission-scanning electron microscope (S-4200, manufactured by Hitachi Ltd.), and introducing the image information into an image analyzer Luzex AP (manufactured by Nireco Corporation) via an interface for analysis.

The toner of the present disclosure preferably has a weight average particle diameter of from 2 to 7 μm and more preferably from 2 to 5 μm.

In addition, when the weight average particle diameter of the toner is too small and the toner is used as a one component development agent, filming of the toner to a development roller and adhesion of the toner to a part, for example, a blade for regulating the layer thickness of the toner, may occur.

When such toner is used as a two component development agent, the toner tends to adhere to the surface of the carrier during agitation in a development unit for an extended period of time, which may lead to deterioration of the charging ability of the carrier.

When the volume average particle diameter is too large, it tends to be difficult to form quality images with high definition and in addition the particle diameter of the toner component may greatly vary in the case of a two development agent when the toner contained in the developing agent is replenished.

In addition, the toner of the present disclosure preferably has a ratio of the weight average particle diameter to the number average particle diameter of from 1.00 to 1.25, and more preferably from 1.00 to 1.15.

When the ratio is too large, the behavior of the toner during development easily varies, and the reproducibility of fine dots tends to deteriorate, thereby degrading the image quality.

The weight average particle diameter and the number average particle diameter of the toner can be measured by using a Coulter Multisizer II (manufactured by Beckman Coulter Inc.).

The glass transition temperature of the toner of the present disclosure is preferably from 40 to 70° C., and more preferably from 45 to 55° C.

When the glass transition temperature is too low, the high-temperature storage of the toner may deteriorate. When the glass transition temperature is too high, the low temperature fixing property may deteriorate.

With regard to the storage elastic modulus of the toner of the present disclosure, the temperature (TG') at which the storage elastic modulus is 10,000 dyne/cm$^2$ when measured at a frequency of 20 Hz is not lower than 100° C., and preferably from 110 to 200° C.

When the temperature (TG') is too low, the hot offset resistance tends to deteriorate.

The temperature Tη at which the toner of the present disclosure has a viscosity of 1,000 poise measured at a frequency of 20 Hz is 180° C. or lower and preferably from 90 to 160° C.

When Tη is too high, the low temperature fixing property tends to deteriorate.

TG'−Tr' is from 0 to 100° C., preferably from 10 to 90° C., and furthermore preferably from 20 to 80° C.

When TG'−Tη is too low, it is difficult to have a good combination of the high-temperature storage and low temperature fixing property. By contrast, when TG'−Tη is too high, the high-temperature storage tends to deteriorate.

The development agent containing the toner of the present disclosure contains carriers and the weight ratio of the toner to the carrier is preferably from 1 to 10%.

There is no specific limit to the selection of the carrier. Iron powder, ferrite powder, or magnetite powder that has a particle diameter of from 20 to 200 μm is suitably used as the carrier.

In addition, the carrier may be coated by a resin.

Specific examples of such resins include, but are not limited to, amino-based resins such as urea-formaldehyde resins, melamine resins, beozoguanamine resins, urea resins, polyamide resins, and epoxy resins; acylic resins such as methyl polymethacrylate, and polyacrylonitrile resins; polyvinyl resins such as polyvinyl acetate, polyvinyl alcohol, and polyvinyl butyral; polystyrene resins such as polystyrene resins, styrene-acrylic copolymers; halogentated olefines such as polyvinyl chloride; polyesters such as polyethylene terephthalate, polybutylene terephthalate; polycarbonate; polyethylene, fluorine-containing resins such as polyvinyl fluoride, polyvinylidene fluoride, polytrifluoroethylene, polyhexafluoropropylene, copolymers of vinylidene fluoride and acylic monomer, copolymers of vinylidene fluoride and vinyl fluoride, terpolymers of tetrafluoroethylene, vinylidene fluoride and a non-fluorine monomer; and silicone resins.

These resins can contain electroconductive powder.

Specific examples of such electroconductive powder include, but are not limited to, metal powder, carbon blacks, titanium oxide, tin oxide, and zinc oxide.

The electroconductive powder preferably has an average particle diameter of 1 μm or smaller.

When the average particle diameter is too large, controlling electric resistance may become difficult.

The toner of the present disclosure can be used as a magnetic toner or a non-magnetic toner without using a carrier.

The image formation method of the present disclosure includes a process of forming a latent electrostatic image on an image bearing member; a process of forming a toner image by developing the latent electrostatic image with the development agent of the present disclosure; a process of transferring the toner image to a recording medium; and a process of fixing the transferred toner image on the recording medium.

In the present disclosure, the toner image is preferably fixed by pressing the recording medium to which the toner image has been transferred with a surface pressure of from 10 to 150 $N/cm^2$.

When the surface pressure applied to the recording medium is too small, the fixing strength of the toner image tends to be insufficient when fixed at a low temperature. By contrast, when the surface pressure applied to the recording medium is too high, the recording medium easily curls or the image quality tends to deteriorate.

The surface pressure applied to the recording medium is measured by using a pressure distribution measuring device (PINCH, manufactured by Nitta Corporation).

The system speed is preferably from 500 to 2,500 mm/s.

When the system speed is too slow, forming images at a high speed is impossible, and hot offset easily occurs since the nipping time (nipping width/system speed) is prolonged. By contrast, when the system speed is too high, the fixing nipping time becomes short, resulting in insufficient fixing property.

The system speed v (mm/s) can be obtained by measuring the time t (s) required to form 100 images sequentially on A4 sheets set in the portrait direction and assigning the measured value into the following relationship.

$$v=100\times297/t.$$

The length of a A4 sheets in the portrait direction is 297 mm.

Figure 2:
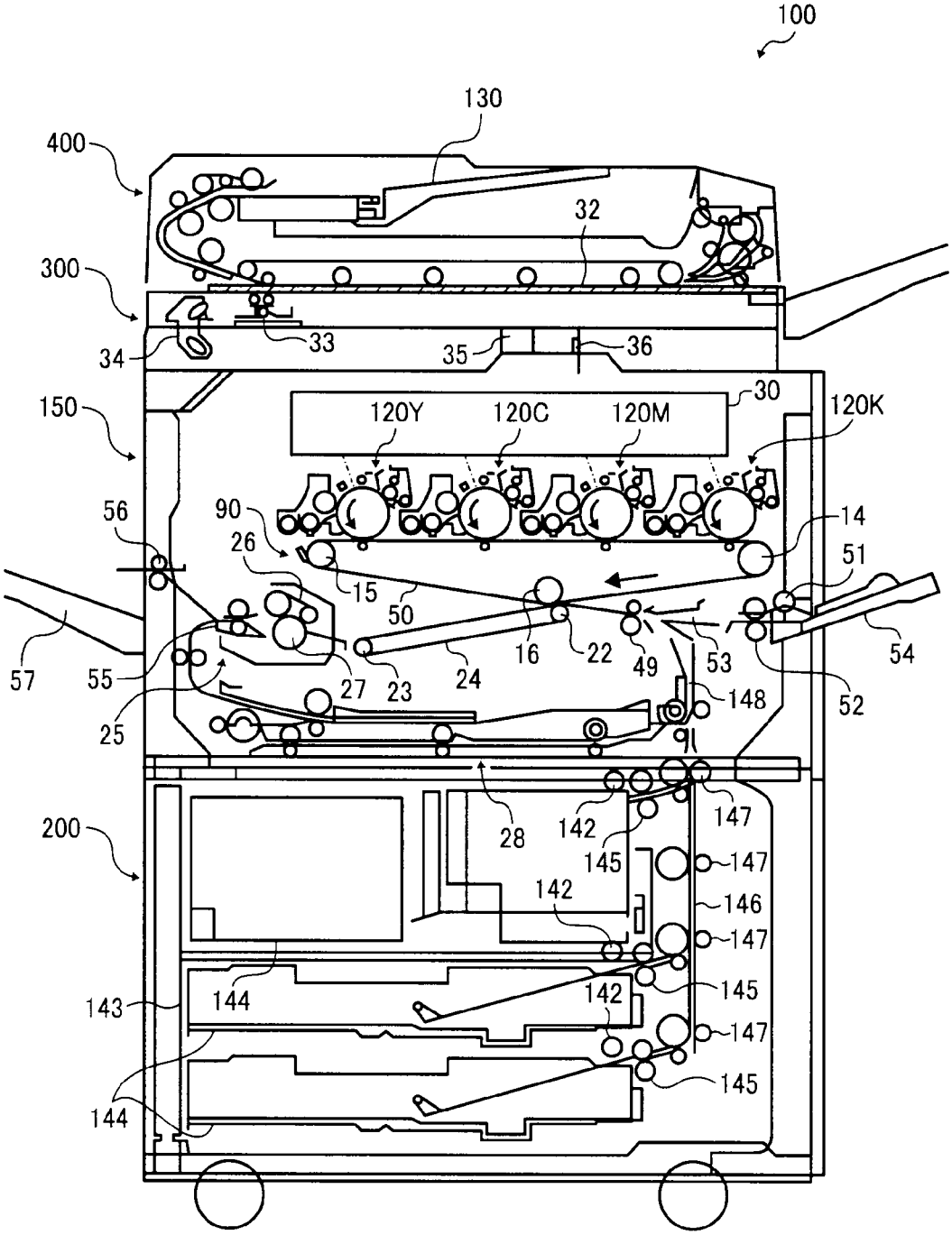
FIG. 2 is a diagram illustrating an example of an image forming apparatus of the present disclosure.

FIG. 2 is a diagram illustrating an example of the image forming apparatus for use in the present disclosure.

An image forming apparatus 100 is a tandem type color image forming apparatus, and includes a photocopying unit 150, a paper feeder table 200, a scanner 300, and a automatic document feeder (ADF) 400.

An intermediate transfer belt 50 provided in the center part of the photocopying unit 150 is an endless belt suspended over three rollers 14, 15, and 16. The intermediate transfer belt 50 moves in the direction indicated by an arrow in FIG. 2.

Around the roller 15, a cleaning device 90 is provided which has a cleaning blade to remove toner remaining on the intermediate transfer belt 50 from which the toner image is transferred to a recording medium.

Image formation units 120Y, 120C, 120M, and 120K for yellow, cyan, magenta and black, respectively are arranged along the transfer direction of the intermediate transfer belt 50 facing the intermediate transfer belt 50 suspended between the rollers 14 and 15.

In addition, an irradiator 30 is provided around the image formation unit 120.

Furthermore, a transfer belt 24 is provided facing the intermediate transfer belt 50 via the image formation unit 120.

The transfer belt 24 is an endless belt suspended over a pair of rollers 22 and 23 and the recording medium transferred on the transfer belt 24 and the intermediate transfer belt 50 can contact with each other between the rollers 16 and 22.

In addition, around the transfer belt 24, there are provided a fixing belt 26 having an endless form suspended over a pair of rollers and a fixing device 25 including a pressure roller 27 pressed by the fixing belt 26.

A sheet reversing device 28 is provided near the transfer belt 24 and the fixing belt 25 to reverse the recording medium when images are formed on both sides of the recording medium.

Next, the method of forming full color images using the image forming apparatus 100 is described.

First, a color document is set on a document table 130 of the automatic document feeder (ADF) 400, or after the automatic document feeder 400 is opened, a color document is set on a contact glass 32 and then the automatic document feeder 400 is shut.

When a start button (not shown) is pressed, the document is transferred to the contact glass 32 when the document is set on the automatic document feeder 400, or the scanner 300 is driven to move a first carrier 33 having a light source and a second carrier having a mirror immediately after the document is set on the automatic document feeder 400. The irradiation light from the first carrier 33 is reflected at the document and the reflected light is reflected at the second carrier 34. Thereafter, the reflected light is received at a reading sensor 36 via an image focusing lens 35 to read the document and thus image information of black, yellow, magenta, and cyan of the document is obtained.

Image information of each color is transmitted to each color image formation unit 120 where each color toner image is formed.

Figure 3:
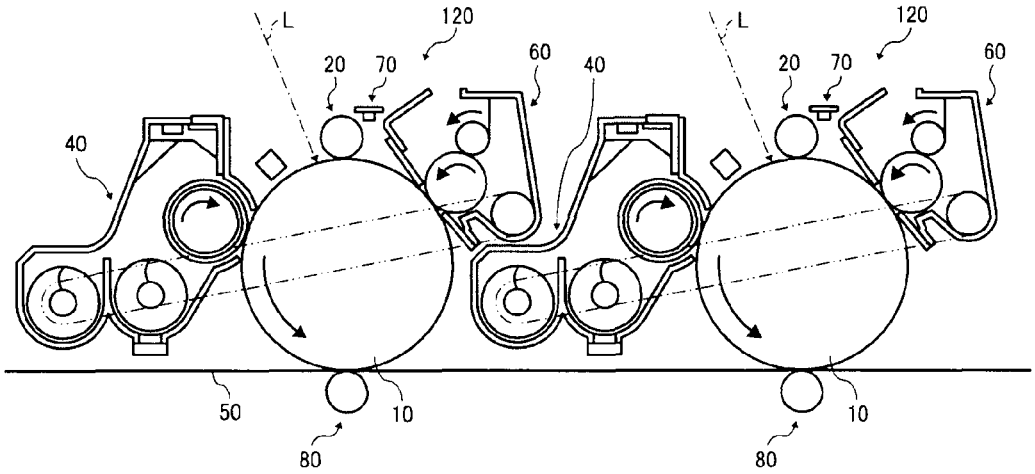
FIG. 3 is a diagram illustrating the image formation unit illustrated in FIG. 2.

As illustrated in FIG. 3, each color image formation unit 120 includes an image bearing drum 10, a charging roller 20 that uniformly charges the image bearing drum 10, a development device 40 that form ELS each color toner image by developing a latent electrostatic image with each color development agent, a transfer roller 80 that transfers the toner image to an intermediate transfer belt 50, a cleaning device 60 having a cleaning blade, and a discharging lamp 70.

An superimposed complex toner image is formed on the intermediate transfer belt 50 suspended over the rollers 14, 15, and 16 by sequentially transferring the each color toner image formed by each color image formation unit 120 to the intermediate transfer belt 50.

In the paper feeder table 200, one of paper feeder rollers 142 is selectively rotated to feed recording media from one of multiple stacks of paper feeder cassettes 144 provided in a paper bank 143. Thereafter, the recording media are separated one by one by a separation roller 145 and one recording medium is sent out to a paper feeding path 146, guided by a transfer roller 147 to a paper feeding path 148 in the photocopying unit 150 and then blocked at registration rollers 49.

Alternatively, recording media on a manual feeder tray 54 are fed by rotating a paper feeder roller 51 and separated one by one by a separation roller 52. The recording medium is fed into a manual feeding path 53, and blocked at the registration rollers 49.

The registration rollers 49 are generally used grounded, but can be biased to remove paper dust on the recording medium.

Next, the registration rollers 49 are rotated to send out the recording medium between the intermediate transfer belt 50 and the transfer belt 24 in synchronization with the complex toner image formed on the intermediate transfer belt 50 so that the complex toner image is secondarily transferred to the recording medium. Residual toner remaining on the intermediate transfer belt 50 from which the complex toner image has been transferred to the recording medium is removed by the cleaning device 90.

The recording medium to which the complex toner image is transferred is transferred by the transfer belt 24 and then fixed by the fixing device 25.

Next, a switching claw 55 switches the transfer route and the recording medium is discharged to a discharging tray 57 by discharging rollers 56.

Alternatively, the switching claw 55 switches the transfer route and the recording medium is reversed by the sheet reversing device 28. Subsequent to image formation on the reverse side of the recording medium, the recording medium is discharged to the discharging tray 57 by the discharging rollers 56.

The image forming apparatus 100 employs the indirect transfer system in which each color toner image formed by each color image formation unit 120 is superimposed by sequentially and primarily transferring the each color toner image followed by secondary transfer to the recording medium. The image forming apparatus 100 may employ a direct system in which each color toner image formed by each color image formation unit 120 is sequentially transferred to and superimposed on the recording medium.

Alternatively, a transfer roller can be used instead of the transfer belt 24.

Thus, as described above in embodiments, the toner is provided which has excellent low temperature fixing property, protection property against winding during fixing, high-temperature storage, pressure resistance storage, development stability, and high speed printing dealing ability and also the development agent containing the toner, and the method of image formation using the toner or the development agent are provided.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Prepolymer

The following recipe is placed in a container equipped with a condenser, a stirrer and a nitrogen introducing tube to conduct a reaction at 230° C. for 7 hours under normal pressure followed by another reaction for 5 hours with a reduced pressure of 10 to 15 mmHg to obtain a non-crystalline intermediate polyester resin ([Intermediate polyester 1]):

Adduct of bisphenol A with 2 mole of ethylene oxide 682 parts

Adduct of bisphenol A with 2 mole of propylene oxide: 81 parts

Terephthalic acid: 283 parts

Trimellitic anhydride: 22 parts

Dibutyl tin oxide: 2 parts

[Intermediate polyester 1] has a number average molecular weight of 2,200, and a weight average molecular weight of 9,700, a glass transition temperature of 54° C., an acid value of 0.5 mgKOH/g. and a hydroxyl value of 52 mgKOH/g.

Next, 410 parts of [Intermediate polyester 1], 89 parts of isophorone diisocyanate and 500 parts of ethyl acetate are placed in a reaction container equipped with a condenser, stirrer and a nitrogen introducing tube to conduct reaction at 100° C. for 5 hours to obtain [Prepolymer 1].

[Prepolymer 1] has an isolated isocyanate content of 1.53% by weight.

Synthesis of Ketimine

In a reaction container equipped with a stirrer and a thermometer, 170 parts of isophoronediamine and 75 parts of methyl ethyl ketone are mixed to conduct reaction at 50° C. for four and a half hours to obtain [Ketimine 1]. [Ketimine 1] has an amine value of 417 mgKOH/g.

Example 1

The following recipe is placed in a container equipped with a stirrer and a thermometer and stirred at 3,800 rpm for 30 minutes:

| | |
|---|---|
| Deionized water | 683 parts |
| Sodium salt of sulfate of an adduct of methacrylic acid with ethyleneoxide (EREMINOR RS-30, manufactured by Sanyo Chemical Industries, Ltd.) | 11 parts |
| Polylactic acid | 10 parts |
| Styrene | 60 parts |
| Methacrylic acid | 100 parts |
| Butyl acrylate | 70 parts |
| Ammonium persulfate | 1 part |

After the system is heated to 75° C. for reaction for four hours, 30 parts of one weight % aqueous solution of ammonium persulfate is added and the system is aged for six hours at 75° C. to obtain [Liquid dispersion 1] of resin particles.

The weight average particle diameter of [Liquid dispersion 1] of resin particles measured by using a laser scattering particle size distribution analyzer LA-920, manufactured by Horiba, Ltd. is 280 nm.

In addition, the resin of [Liquid dispersion 1] of the resin particles is isolated. The isolated resin has a glass transition temperature of 59° C., and a weight average molecular weight of 60,000.

900 parts of deionized water, 83 parts of [Liquid dispersion 1] of the resin particles, 37 parts of 48.3% aqueous solution of sodium dodecyldiphenyl etherdisulfonate (EREMINOR MON-7, manufactured by Sanyo Chemical Industries, Ltd.), and 90 parts of ethyl acetate are mixed and stirred to obtain milk white [Aqueous medium 1].

The following recipe is placed in a container equipped with a condenser, a stirrer and a nitrogen introducing tube to conduct a reaction at 230° C. for seven hours under normal pressure followed by another reaction for five hours with a reduced pressure of 10 to 15 mmHg:

Adduct of bisphenol A with 2 mole of ethylene oxide 229 parts

Adduct of bisphenol A with 3 mole of propylene oxide: 329 parts

Terephthalic acid: 208 parts

Adipic acid: 80 parts

Dibutyl tin oxide: 2 parts Then, 35 parts of trimellitic anhydride is added to conduct reaction for two hours at 180° C. under normal pressure to obtain non-crystalline [Polyester resin 1]. The non-crystalline [Polyester resin 1] has a number average molecular weight of 2,000, and a weight average molecular weight of 3,800, a glass transition temperature of 40° C. and an acid value of 25 mgKOH/g.

1,200 parts of deionized water, 540 parts of carbon black (Printex 35 from Degussa AG, which has a dibutyl phthalate (DBP) oil absorption of 42 ml/100 mg and has a PH of 9.5), and 1,200 parts of [Polyestere 1] are admixed by a Henshel mixer (manufactured by Mitsui Mining Company, Limited). The mixture is mixed and kneaded for on hour at 110° C. using a two-roll mill followed by rolling and cooling down. Thereafter, the kneaded mixture is pulverized by a pulverizer to prepare [Master batch 1].

The following components are placed in a reaction container equipped with a stirrer and a thermometer:

| | |
|---|---|
| [Polyester 1] | 378 parts |
| Paraffin wax having a glass transition point of 71° C. | 100 parts |
| Ethyl acetate | 947 parts |

The system is heated to 80° C. with stirring and maintained at 80° C. for five hours followed by cooling down to 30° C. in one hour. Then, 500 parts of [Master Batch 1] and 500 parts of ethyl acetate are added in the container and mixed for one hour.

1,324 parts of the obtained liquid mixture is moved to a container and dispersion is conducted under the condition of a liquid transfer speed of 1 kg/hour, a disc circumference speed of 6 m/sec, 80 volume % filling of zirconia beads having a particle diameter of 0.5 mm, and 3 passes using a beads mill (ULTRAVISCOMILL, manufactured by Aimex Co., Ltd.). Next, 1324 parts of 65 weight % ethyl acetate solution of [Polyester 1] is added to the liquid dispersion followed by 2 passes using the beads mill under the conditions specified above to obtain [Liquid dispersion 1]. [Liquid dispersion 1] is dried at 130° C. for 30 minutes. The solid concentration is 50% weight.

749 parts of [Liquid dispersion 1], 115 parts of [Prepolymer 1], and 2.9 parts of [Ketimine 1] are placed in the container and the resultant is mixed for two minutes using a TK HOMOMIXER (manufactured by Tokushu Kika Kogyo Co., Ltd.) at 5,000 rpm. Subsequent to an addition of 1,200 parts of [Aqueous medium 1], the resultant is mixed by the TK HOMOMIXER at 13,000 rpm for 25 minutes to obtain an emulsified slurry.

Furthermore, the emulsified slurry is placed in a reaction container equipped with a stirrer and a thermometer followed by removal of the solvent at 30° C. for eight hours. Subsequent to a 24 hour aging at 40° C., [Dispersion slurry 1] is obtained.

After 100 parts of [Dispersion slurry 1] is filtered with a reduced pressure, 100 parts of deionized water is added to the filtered cake followed by mixing by a TK HOMOMIXER at 12,000 rpm for 10 minutes and filtration.

100 parts of aqueous solution of 10 weight % sodium hydroxide is added to the thus obtained filtered cake. The resultant is mixed by a TK HOMOMIXER at 12,000 rpm for 30 minutes followed by filtration with a reduced pressure to obtain a filtered cake.

Then, 100 parts of ten weight % hydrochloric acid is added to the obtained filtered cake and the resultant is mixed by a TK HOMOMIXER at 12,000 rpm for 10 minutes followed by filtration to obtain a filtered cake. Then, 300 parts of deionized water is added to the obtained filtered cake and the resultant is mixed by a TK HOMOMIXER at 12,000 rpm for 10 minutes followed by filtration. This process is repeated twice to obtain a filtered cake.

The obtained filtered cake is dried by a circulation drier at 45° C. for 48 hours. The dried cake is sieved by using a screen having an opening of 75 μm to obtain mother particles.

100 parts of the obtained mother particles and 1 part of hydrophobized silica having a particle diameter of 13 nm are mixed with a Henschel mixer to obtain a toner.

Example 2

The following recipe is placed in a container equipped with a stirrer and a thermometer and stirred at 3,800 rpm for 20 minutes:

| | |
|---|---|
| Deionized water | 683 parts |
| Sodium salt of sulfate of an adduct of methacrylic acid with ethyleneoxide (EREMINOR RS-30, manufactured by Sanyo Chemical Industries, Ltd.) | 11 parts |
| Polylactic acid | 10 parts |
| Styrene | 60 parts |
| Methacrylic acid | 100 parts |
| Butyl acrylate | 70 parts |
| Ammonium persulfate | 1 part |

After the system is heated to 75° C. for reaction for three hours, 30 parts of one weight % aqueous solution of ammonium persulfate is added and the system is aged for 12 hours at 65° C. to obtain [Liquid dispersion 2] of resin particles.

The weight average particle diameter of [Liquid dispersion 2] of the resin particles measured by using a laser scattering particle size distribution analyzer LA-920, manufactured by Horiba, Ltd. is 390 nm.

In addition, the resin of [Liquid dispersion 2] of resin particles is isolated. The isolated resin has a glass transition temperature of 60° C., and a weight average molecular weight of 70,000.

A toner is manufactured in the same manner as in Example 1 except that [Liquid dispersion 2] of the resin particles is used instead of [Liquid dispersion 1] of the resin particles.

Example 3

The following recipe is placed in a container equipped with a stirrer and a thermometer and stirred at 2,000 rpm for 20 minutes:

| | |
|---|---|
| Deionized water | 683 parts |
| Sodium salt of sulfate of an adduct of methacrylic acid with ethyleneoxide (EREMINOR RS-30, manufactured by Sanyo Chemical Industries, Ltd.) | 11 parts |
| Polylactic acid | 10 parts |
| Styrene | 60 parts |
| Methacrylic acid | 100 parts |
| Butyl acrylate | 70 parts |
| Ammonium persulfate | 1 part |

After the system is heated to 75° C. for reaction for 3 hours, 30 parts of one weight % aqueous solution of ammonium persulfate is added and the system is aged for 12 hours at 65° C. to obtain [Liquid dispersion 3] of resin particles. The weight average particle diameter of [Liquid dispersion 3] of resin particles measured by using a laser scattering particle size distribution analyzer LA-920, manufactured by Horiba, Ltd. is 640 nm.

In addition, the resin of [Liquid dispersion 3] of resin particles is isolated. The isolated resin has a glass transition temperature of 59° C., and a weight average molecular weight of 120,000.

The following recipe is placed in a container equipped with a condenser, a stirrer and a nitrogen introducing tube to conduct a reaction at 230° C. for 9 hours under normal pressure followed by another reaction for 5 hours with a reduced pressure of 10 to 15 mmHg:

| | |
|---|---|
| Adduct of bisphenol A with 2 mole of ethylene oxide | 229 parts |
| Adduct of bisphenol A with 3 mole of propylene oxide | 264 parts |
| Terephthalic acid | 208 parts |
| Adipic acid | 80 parts |
| Dibutyl tin oxide | 2 parts |

Then, 35 parts of trimellitic anhydride is added to conduct reaction for two hours at 180° C. under normal pressure to obtain non-crystalline [Polyester resin 2].

The non-crystalline [Polyester resin 2] has a number average molecular weight of 1,800, a weight average molecular weight of 3,500, a glass transition temperature of 38° C. and an acid value of 25 mgKOH/g.

A toner is manufactured in the same manner as in Example 1 except that [Liquid dispersion 3] of the resin particles and the non-crystalline [Polyester resin 2] is used instead of [Liquid dispersion 3] of the resin particles and the non-crystalline [Polyester resin 1].

Example 4

A toner is manufactured in the same manner as in Example 1 except that the non-crystalline [Polyester resin 2] is used instead of the non-crystalline [Polyester resin 1].

Synthesis of [Crystalline Polyester Resin]

120 parts by weight of 1,10decane diol, 80 parts of 5-sulfoisophthalic acid sodium dimethyl, 4 parts of dimethyl sulfoxide, 3 parts of polylactic acid, and 0.02 parts of catalyst (=dibutyl tin oxide), are placed in a heated and dried flask. Thereafter, the flask is filled with $N_2$ to be under inert gas atmosphere by a reduced pressure operation followed by three hour stirring at 180° C. by mechanical stirring.

Under a reduced pressure, dimethyl sulfoxide is removed and 23 parts of dodecane dioic acid dimethyl is added in a nitrogen atmosphere followed by 45 minute stirring at 160° C.

Thereafter, the system is gradually heated to 220° C. under a reduced pressure. After the system is into gruel, the system is cooled down by air to terminate the reaction. Thus, [Crystalline polyester resin 2-1] is synthesized.

The obtained [Crystalline polyester resin 2-1] has a glass transition temperature of 70° C., a number average molecular weight of 4,200, and a weight average molecular weight of 18,000.

In addition, the acid value of [Crystalline polyester resin 2-1] is 10 mgKOH/g according to KOH titration.

Synthesis of [Non-Crystalline Polyester Resin 2-1]

112 parts of naphthalene dicarboxylic acid dimethyl, 97 parts of terephthalic acid dimethyl, 221 parts of an adduct of bisphenol A with two mole of ethylene oxide, and 80 parts of ethylene glycol, 0.07 pats of tetrabutoxy titanate are placed in a heated and dried flask followed by ester exchange reaction by heating at 170 to 220° C. for 180 minutes.

Next, another reaction is conducted for 45 minutes at 220° C. with a system pressure of 1 to 10 mmHg to synthesize [Non-crystalline polyester resin 2-1].

The obtained [Non-crystalline polyester resin 2-1] has a glass transition temperature of 64° C., a number average molecular weight of 3,200, and a weight average molecular weight of 17,000.

In addition, the acid value of this resin is 10 mgKOH/g according to KOH titration.

Example 5

Manufacturing of Toner 5

Preparation of [Liquid Dispersion 2-1] of Resin Particulate

[Crystalline polyester resin 2-1] is coarsely pulverized with a hammer mill to prepare [Liquid dispersion 2-1] of resin particulate 50 parts of ethyl acetate, and 110 parts of isopropyl alcohol (IPA) are added in a separable flask equipped with an anchor wing providing a stirring driving force, a reflux device, and a pressure reduction device by a vacuum pump, and $N_2$ air is sent into the flask with a speed of 0.2 L/m to replace the air in the system with $N_2$.

Next, 200 parts of [Crystalline polyester resin 2-1] is slowly added and dissolved with stirring while heating the system to 60° C. in an oil bath in the system.

Then, after 20 parts of 10% ammonia water is added, 460 parts of deionized water is added with a speed of 9.6 g/m while stirring using a metering pump. This emulsification is determined to complete when the system indicates milk while and the stirring viscosity decreases.

Then, the pressure to the system is reduced to −700 Torr and the system is stirred for 40 minutes.

Furthermore, 50 parts of 60° C. pure water is added and stirring with the reduced pressure is maintained for 20 minutes.

The time when the reflux amount reaches 210 parts is determined to be a terminal point. Then, heating is ceased and the system is cooled down to room temperature while stirring.

Thus, [Liquid dispersion 2-1] of resin particulate is prepared.

The average particle diameter of the obtained resin particulates measured by a particle size distribution analyzer (LA-920, manufactured by Horiba Ltd.) is 303 nm.

Preparation of Aqueous Phase 500 parts of deionized water, [Liquid dispersion 2-1] of resin particulate, 23 parts of 48.3 weight % aqueous solution of sodium dodecyldiphenyl etherdisulfonate (EREMINOR MON-7, manufactured by Sanyo Chemical Industries, Ltd.), and 50 parts of ethyl acetate are mixed and stirred to obtain milk white liquid.

This is determined to be [Aqueous phase].

Synthesis of Non-Crystalline Polyester Having Low Molecular Weight

The following components are placed in a container equipped with a condenser, a stirrer and a nitrogen introducing tube to conduct a reaction at 230° C. at normal pressure for seven hours:

| | |
|---|---|
| Adduct of bisphenol A with 2 mole of ethylene oxide | 229 parts |
| Adduct of bisphenol A with 3 mole of propylene oxide | 329 parts |
| Terephthalic acid | 208 parts |
| Adipic acid | 80 parts |
| Dibutyl tin oxide | 2 parts |

Subsequent to another reaction for five hours with a reduced pressure of 10 to 15 mmHg, 36 parts of trimellitic anhydride is added in the reaction container to conduct reaction for two hours at 180° C. under normal pressure to obtain [Non-crystalline polyester resin having small molecular weight 2-1].

[Non-crystalline polyester resin having small molecular weight 2-1]. has a number average molecular weight of 2,000, and a weight average molecular weight of 3,800, a glass transition temperature of 40° C. and an acid value of 25 mgKOH/g.

[Non-crystalline Intermediate Polyester] is synthesized in the same manner as described above.

Preparation of Oil Phase 378 parts of [Non-crystalline polyester having a small molecular weight 2-1], 100 parts of paraffin wax (glass transition temperature: 71° C.), and 947 pars of ethyl acetate are placed in a reaction container equipped with a stirrer and a thermometer. After the system is heated to 80° C. while stirring, the system is maintained at 80° C. for 5 hours and then cooled down to 30° C. in one hour.

Next, 500 parts of [Master batch 1] and 500 parts of ethyl acetate are placed in the reaction container followed by mixing for one hour to obtain [Raw material solution 2-1].

1,324 parts of the obtained [Raw material solution 2-1] is moved to a container. Carbon black and wax are dispersed under the condition of a liquid transfer speed of 1 kg/hour, a disc circumference speed of 6 m/sec, 80 volume % filling of zirconia beads having a diameter of 0.5 mm, and 3 passes using a beads mill (ULTRAVISCOMILL, manufactured by Aimex Co., Ltd.).

Next, 1324 parts of 65 weight % ethyl acetate solution of [Non-crystalline polyester having a small molecular weight 2-1] is added to the liquid dispersion followed by 2 passes using the beads mill under the conditions specified above to obtain [Liquid dispersion of pigment and wax 2-1]. The solid portion of the obtained [Liquid dispersion of pigment and wax 2-1] is 50% at 130° C. for 30 minutes.

Emulsification and Removal of Solvent 749 parts of [Liquid dispersion of pigment and wax 2-1], 115 parts of [Prepolymer 1], and 2.9 parts of [Ketimine 1] are placed in a container and mixed by a TK HOMOMIXER (manufactured by Tokushu Kika Kogyo Co., Ltd.) at 5,000 rpm for two minutes. Thereafter, 1,200 parts of [Aqueous phase 1] is added in the container and the mixture is mixed by the TK HOMOMIXER at 13,000 rpm for 25 minutes to obtain [Emulsified slurry 2-1].

Then, [Emulsified slurry 2-1] is placed in a reaction container equipped with a stirrer and a thermometer followed by removal of the solvent at 30° C. for 8 hours. Subsequent to a 24 hour aging at 40° C., [Slurry dispersion 2-1] is obtained.

Washing and Drying 100 parts of [Slurry dispersion 2-1] is filtered with a reduced pressure followed by washing and drying as follows:

(1): 100 parts of deionized water is added to the filtered cake and the mixture is mixed by a TK HOMOMIXER at 12,000 rpm for 10 minutes followed by filtration;

(2): 100 parts of 10% sodium hydroxide is added to the filtered cake obtained in (1) and the resultant is mixed by a TK HOMOMIXER at 12,000 rpm for 30 minutes followed by filtration with a reduced pressure.

(3): 100 parts of 10% hydrochloric acid is added to the filtered cake obtained in (2) and the resultant is mixed by a TK HOMOMIXER at 12,000 rpm for 10 minutes followed by filtration.

(4): 300 parts of deionized water is added to the filtered cake obtained in (3) and the resultant is mixed by a TK HOMOMIXER at a rotation number of 12,000 rpm for 10 minutes followed by filtration twice to obtain [Filtered cake 2-1].

The obtained [Filtered cake 2-1] is dried by a circulation drier at 45° C. for 480 hours.

The dried resultant is screened by a mesh having an opening of 75 μm to obtain mother toner particles.

Thereafter, 100 parts of the obtained mother toner particles, and 1 part of hydrophobized silica having a particle diameter of 13 nm are mixed with a HENSCHEL MIXER to prepare [Toner 5].

Example 6

Manufacturing of Toner 6

[Toner 6] is manufactured in the same manner as in Example 5 except that [Liquid dispersion 2-1] of resin particulates is changed to the following [Liquid dispersion 2-2] of resin particulates.

Preparation of [Liquid Dispersion 2-2] of Resin Particulate

[Crystalline polyester resin 2-1] is coarsely pulverized with a hammer mill to prepare [Liquid dispersion 2-2] of resin particulates.

50 parts of ethyl acetate, and 110 parts of isopropyl alcohol (IPA) are added in a separable flask equipped with an anchor wing providing stirring driving force, a reflux device, and a pressure reduction device by a vacuum pump, and $N_2$ air is sent into the flask with a speed of 0.2 L/m to replace the air in the system with $N_2$. Next, 200 parts of [Crystalline polyester resin 2-1] is slowly added and dissolved with stirring while heating the system to 60° C. in an oil bath in the system. Then, after 20 parts of 10% ammonia water is added, 460 parts of deionized water is added with a speed of 4.0 g/m while stirring using a metering pump. This emulsification is determined to complete when the system indicates milk while and the stirring viscosity decreases.

Then, the pressure to the system is reduced to −700 Torr and the system is stirred for 40 minutes. Furthermore, 50 parts of 60° C. pure water is added and stirring with the reduced pressure is maintained for 20 minutes. The time when the reflux amount reaches 210 parts is determined to be a terminal point and heating is ceased, and the system is cooled down to room temperature while stirring. Thus, [Liquid dispersion 2-2] of resin particulates is prepared.

The average particle diameter of the obtained resin particulates measured by a particle size distribution analyzer (LA-920, manufactured by Horiba Ltd.) is 924 nm.

Example 7

Manufacturing of Toner 7

[Toner 7] is manufactured in the same manner as in Example 5 except that [Liquid dispersion 2-1] of resin particulates is changed to the following [Liquid dispersion 2-3] of resin particulates.

Preparation of [Liquid Dispersion 2-3] of Resin Particulate

[Crystalline polyester resin 2-1] and [Non-crystalline Polyester resin 2-1] are coarsely pulverized with a hammer mill to prepare [Liquid dispersion 2-3] of resin particulate as follows:

50 parts of ethyl acetate, and 110 parts of isopropyl alcohol (IPA) are added in a separable flask equipped with an anchor wing providing stirring driving force, a reflux device, and a pressure reduction device by a vacuum pump, and $N_2$ air is sent into the flask with a speed of 0.2 L/m to replace the air in the system with $N_2$.

Next, 150 parts of [Crystalline polyester resin 1] and 50 parts of [Non-crystalline Polyester resin 2-1] are slowly added and dissolved with stirring while heating the system to 60° C. in an oil bath in the system.

Then, after 20 parts of 5% ammonia water is added, 460 parts of deionized water is added with a speed of 4.0 g/m while stirring using a metering pump. This emulsification is determined to complete when the system indicates milk while and the stirring viscosity decreases.

Then, the pressure to the system is reduced to −700 Torr and the system is stirred for 40 minutes. Furthermore, 50 parts of 60° C. pure water is added and stirring with the reduced pressure is maintained for 20 minutes. The time when the reflux amount reaches 210 parts is determined to be a terminal point and heating is ceased and the system is cooled down to room temperature while stirring. Thus, [Liquid dispersion 2-3] of resin particulates is prepared.

The average particle diameter of the obtained resin particulates measured by a particle size distribution analyzer (LA-920, manufactured by Horiba Ltd.) is 1,130 nm.

Example 8

Manufacturing of Toner 8

[Toner 8] is manufactured in the same manner as in Example 5 except that [Liquid dispersion 2-1] of resin particulates is changed to the following [Liquid dispersion 2-4] of resin particulates.

Preparation of [Liquid Dispersion 2-4] of Resin Particulate

[Crystalline polyester resin 2-1] and [Non-crystalline Polyester resin 2-1] are coarsely pulverized with a hammer mill to prepare [Liquid dispersion 2-4] of resin particulate as follows:

50 parts of ethyl acetate, and 110 parts of isopropyl alcohol (IPA) are added in a separable flask equipped with an anchor wing providing stirring driving force, a reflux device, and a pressure reduction device by a vacuum pump, and $N_2$ air is sent into the flask with a speed of 0.2 L/m to replace the air in the system with $N_2$.

Next, 100 parts of [Crystalline polyester resin 1] and 100 parts of [Non-crystalline Polyester resin 2-1] are slowly added and dissolved with stirring while heating the system to 60° C. in an oil bath in the system. Then, after 20 parts of 10% ammonia water is added, 460 parts of deionized water is added with a speed of 9.6 g/m while stirring using a metering pump. This emulsification is determined to complete when the system indicates milk while and the stirring viscosity decreases.

Then, the pressure to the system is reduced to −700 Torr and the system is stirred for 40 minutes.

Furthermore, 50 parts of 60° C. pure water is added and stirring with the reduced pressure is maintained for 20 minutes.

The time when the reflux amount reaches 210 parts is determined to be a terminal point and heating is ceased and the system is cooled down to room temperature while stirring.

Thus, [Liquid dispersion 2-4] of resin particulates is prepared.

The average particle diameter of the obtained resin particulates measured by a particle size distribution analyzer (LA-920, manufactured by Horiba Ltd.) is 176 nm.

Comparative Example 1

The following recipe is placed in a container equipped with a stirrer and a thermometer and stirred at 3,800 rpm for 30 minutes:

| | |
|---|---|
| Deionized water | 683 parts |
| Sodium salt of sulfate of an adduct of methacrylic acid with ethyleneoxide (EREMINOR RS-30, manufactured by Sanyo Chemical Industries, Ltd.) | 11 parts |
| Polylactic acid | 10 parts |
| Styrene | 60 parts |
| Methacrylic acid | 100 parts |
| Butyl acrylate | 70 parts |
| Ammonium persulfate | 1 part |

After the system is heated to 75° C. for reaction for four hours, 30 parts of one weight % aqueous solution of ammonium persulfate is added and the system is aged for 6 hours at 75° C. to obtain [Liquid dispersion 4] of resin particles.

The weight average particle diameter of [Liquid dispersion 4] of the resin particles measured by using a laser scattering particle size distribution analyzer LA-920, manufactured by Horiba, Ltd. is 105 nm.

In addition, the resin of [Liquid dispersion 4] of resin particles is isolated. The isolated resin has a glass transition temperature of 58° C., and a weight average molecular weight of 140,000.

[Toner 9] is manufactured in the same manner as in Example 1 except that [Liquid dispersion 4] of resin particles is used instead of [Liquid dispersion 1] of resin particles.

[Toner 9] does not have a core-shell structure.

Comparative Example 2

The following recipe is placed in a container equipped with a stirrer and a thermometer and stirred at 1,500 rpm for 20 minutes:

| | |
|---|---|
| Deionized water | 683 parts |
| Sodium salt of sulfate of an adduct of methacrylic acid with ethyleneoxide (EREMINOR RS-30, manufactured by Sanyo Chemical Industries, Ltd.) | 11 parts |
| Polylactic acid | 10 parts |
| Styrene | 60 parts |
| Methacrylic acid | 100 parts |
| Butyl acrylate | 70 parts |
| Ammonium persulfate | 1 part |

After the system is heated to 75° C. for reaction for three hours, 30 parts of one weight % aqueous solution of ammonium persulfate is added and the system is aged for 12 hours at 65° C. to obtain [Liquid dispersion 5] of resin particles.

The weight average particle diameter of [Liquid dispersion 5] of resin particles measured by using a laser scattering particle size distribution analyzer LA-920, manufactured by Horiba, Ltd. is 720 nm. In addition, the resin of [Liquid dispersion 5] of resin particles is isolated. The isolated resin has a glass transition temperature of 57° C., and a weight average molecular weight of 120,000.

[Toner 10] is manufactured in the same manner as in Example 1 except that [Liquid dispersion 5] of resin particles is used instead of [Liquid dispersion 1] of resin particles.

Comparative Example 3

The following recipe is placed in a container equipped with a condenser, a stirrer and a nitrogen introducing tube to conduct a reaction at 230° C. for ten hours under normal pressure followed by another reaction for eight hours with a reduced pressure of 10 to 15 mmHg:

| | |
|---|---|
| Adduct of bisphenol A with 2 mole of ethylene oxide | 229 parts |
| Adduct of bisphenol A with 2 mole of propylene oxide | 529 parts |
| Terephthalic acid | 208 parts |
| adipic acid | 46 parts |
| Dibutyl tin oxide | 2 parts |

Then, 70 parts of trimellitic anhydride is added to conduct reaction for three hours at 180° C. under normal pressure to obtain [Polyester 3].

[Polyester 3] has a number average molecular weight of 2,800, and a weight average molecular weight of 7,300, a glass transition temperature of 47° C. and an acid value of 25 mgKOH/g.

[Toner 11] is manufactured in the same manner as in Example 1 except that [Polyester 3] is used instead of [Polyester 1].

The characteristics of the obtained toners are shown in Table 1.

TABLE 1

| | Ct ° C. | St | Thickness of Shell (μm) | Average Circularity | SF-1 | SF-2 | D4 (μm) | D4/Dn | Crystalline polyester |
|---|---|---|---|---|---|---|---|---|---|
| Ex. 1 | 83 | 1.4 | 0.6 | 0.96 | 131 | 121 | 4.7 | 1.04 | No |
| EX. 2 | 77 | 1.6 | 1.2 | 0.93 | 129 | 131 | 4.4 | 1.16 | No |
| Ex. 3 | 63 | 1.8 | 1.9 | 0.98 | 116 | 113 | 3.1 | 1.19 | No |
| EX. 4 | 60 | 0.7 | 0.2 | 0.94 | 132 | 138 | 4.9 | 1.14 | No |
| Ex. 5 | 83 | 1.5 | 0.4 | 0.96 | 130 | 124 | 4.8 | 1.12 | Yes |
| EX. 6 | 77 | 1.7 | 1.3 | 0.95 | 131 | 126 | 4.5 | 1.15 | Yes |
| Ex. 7 | 63 | 1.8 | 1.8 | 0.98 | 115 | 111 | 3.3 | 1.22 | Yes |
| EX. 8 | 60 | 0.7 | 0.2 | 0.94 | 139 | 129 | 5.1 | 1.19 | Yes |
| Comp. Ex. 1 | 81 | 0.6 | — | 0.98 | 117 | 122 | 49 | 1.20 | No |
| Comp. Ex. 2 | 88 | 1.9 | 2.0 | 0.92 | 138 | 157 | 5.3 | 1.23 | No |
| Comp. Ex. 3 | 87 | 1.5 | 1.2 | 0.93 | 156 | 156 | 7.3 | 1.23 | No |

The evaluation method of the characteristics of the toners is described below.

Softening Index Ct of Core and Thermal Hardness of Shell

The toners are evaluated by using a flow tester (CFT-500D, manufactured by Shimadzu Corporation).

To be specific, 1 g of the toner is molded by pressure to a cylinder form having a diameter of one cm and a toner T having tablet form is obtained.

Next, as illustrated in FIG. 1A, the toner T is set in a cylinder C. Subsequent to preliminarily heating for 200 seconds, the toner T is heated to $T_s$ (50° C.).

Figure 1B:
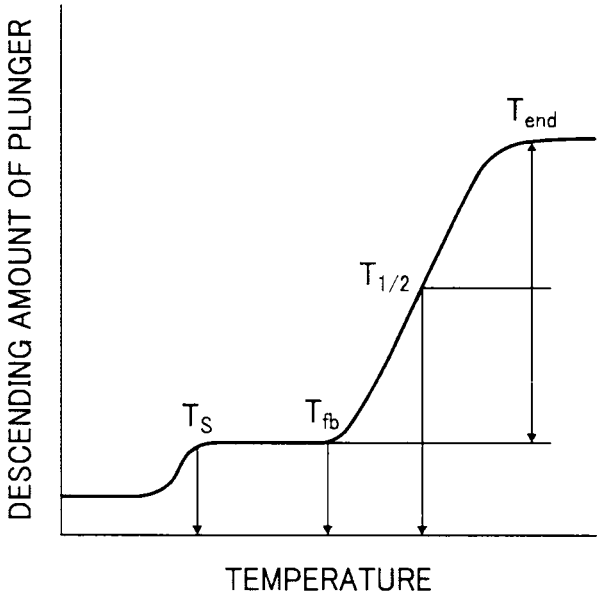

Furthermore, while applying a certain amount of load (2 to 25 Kg) by a plunger P, a heating body H is heated at a speed of 3° C./minute to $T_{end}$ (efflux complete temperature) to cause the melted toner T to outflow from a die D. The descending amount of the plunger P against the temperature of the heating body H is measured as illustrated in FIG. 1B.

The die D has a diameter of 0.5 mm and a length of 1.0 mm.

Thickness of Shell

After the toner is embedded in an epoxy-based resin, the shell and the core are discriminated by dyeing through gas exposure of ruthenium tetroxide for five minutes.

Then, the cross section is exposed by a knife to manufacture ultra thin toner segments having a thickness of 200 nm using an ultramicrotome (ULTRACUT UCT, manufactured by Leica Ag).

Furthermore, the ultra thin toner segments are observed by a transmission electron microscope (TEM) (H7000, manufactured by Hitachi High-Technologies Corporation) with an acceleration voltage of 100 kV to measure the thickness of the shell.

The thickness of the shell of ten toner particles is measured and the average thickness is calculated.

Average Circularity

An average circularity is measured by using a flow type particle image analyzer (FPIA-2100) and an analysis software (FPIA-2100, Data processing program for FPIA version 00-10, manufactured by Sysmex Corporation).

To be specific, 0.1 to 0.5 ml of ten weight % surface active agent (alkylbenzene sulfonate, NEOGEN SC-A, manufactured by Daiichi Kogyo Co., Ltd.) and 0.1 to 0.5 g of the toner are placed in a glass beaker and stirred by a microspatula. Thereafter, 80 ml of deionized water is added.

The average circularity is measured when the concentration of the thus obtained liquid dispersion dispersed by an ultrasonic wave disperser (manufactured by Honda Electronics Co., Ltd.) for three minutes is 5,000 to 15,000 particles/μl.

Shape Factors SF-1 and SF-2

300 samples are randomly selected from SEM images of the toner particles photographed by a field emission scanning electron microscope (FE-SEM) (S-4200, manufactured by Hitachi Ltd.). The image information is introduced into and analyzed by an image analyzer (Luzex AP, manufactured by Nireco Corporation) via an interface to calculate the shape factors of SF-1 and SF-2 of the toner.

Number Average Particle Diameter Dn and Weight Average Particle Diameter $D_4$

The number average particle diameter and the weight average particle diameter of the toner are measured by Coulter Multisizer III (manufacture by Beckman Coulter Inc.).

To be specific, 0.1 to 5 ml of a surface active agent (polyoxyethylene alkyl ether) is added in 100 to 150 ml of an electrolyte (ISOTON-II, manufactured by Beckman Coulter Inc.).

Next, 2 to 20 mg of the toner is added and dispersed by an ultrasonic disperser for about one to about three minutes.

The number average particle diameter and the weight average particle diameter of the obtained sample liquid dispersion are measured by an 100 μm aperture.

The whole range is a particle diameter of from 2.00 to less than 40.30 μm and the number of the channels is 13. Each channel is: from 2.00 to not greater than 2.52 μm; from 2.52 to not greater than 3.17 μm; from 3.17 to not greater than 4.00 μm; from 4.00 to not greater than 5.04 μm; from 5.04 to not greater than 6.35 μm; from 6.35 to not greater than 8.00 μm; from 8.00 to not greater than 10.08 μm; from 10.08 to not greater than 12.70 μm; from 12.70 to not greater than 16.00 μm, from 16.00 to not greater than 20.20 μm; from 20.20 to not greater than 25.40 μm; from 25.40 to not greater than 32.00 μm; and from 32.00 to less than 40.30 μm.

Manufacturing of Carrier 450 parts of toluene, 450 parts of silicone resin having a non-volatile amount of 50 weight % (SR2400, manufactured by Dow Corning Toray), 10 parts of aminosilane (SH6020, manufactured by Dow Corning Toray), and 10 parts of carbon black are dispersed by a stirrer for ten minutes to prepare a liquid application for cover layer.

The obtained liquid application for cover layer and 5,000 parts of Mn ferrite having a weight average particle diameter of 35 μm are placed in an application device that applies liquid while forming a swirl flow by a rotary base plate disc and a stirring wing provided in the flowing bed to apply the liquid application for cover layer to the Mn ferrite.

Then, the resultant is baked at 250° C. for two hours to obtain a carrier having a cover layer with an average thickness of 0.5 μm.

Manufacturing of Development Agent 100 parts of the carrier and the 7 parts of the toner are uniformly mixed and charged by a tabular mixer that stirs material by rolling the container and thus a development agent is obtained.

Evaluation of Development Agent

The development agent is evaluated using a machine prepared by remodeling the development unit and the fixing unit of imagio MP C7500 (manufactured by Ricoh Co., Ltd.).

To be specific, the development gap is 1.26 mm, the doctor blade gap is 1.6 mm and the reflection type photosensor is off so that the machine has a system speed of 1,700 mm/sec.

In addition, the fixing unit of the fixing portion has a surface pressure of 39 N/cm$^2$ of the fixing roll with which the recording medium having a transferred toner image is pressed, and a fixing nip width of 10 mm.

The fixing roll is manufactured by coating tetrafluoroethylene-perfluoroalkyl vinyl ether copolymer (PFA) on the surface followed by molding and surface adjustment treatment.

In addition, the machine is controlled such that the actual temperature range of the image bearing member, the development device and the transfer device is from 30 to 45° C.

Furthermore, the heating temperature of the fixing roll is set to be 150° C.

Measuring of System Speed

The system linear speed is obtained by outputting A4 100 sheets sequentially set in the portrait direction (29 mm along the paper-passing direction). The system linear speed is obtained by the following relationship, where A represents the output time (seconds) from the start to end and B represents the system linear speed.

$$B\ (\text{mm/sec}) = 100\ \text{sheets} \times 297\ \text{mm}/A\ \text{sec.}$$

The evaluation results of the development agent are shown in Table 2.

TABLE 2

| | Low Temperature Fixing Property | High Temperature Fixing Property | Development Stability | Winding |
|---|---|---|---|---|
| Ex. 1 | G | G | G | G |
| EX. 2 | G | E | G | E |
| Ex. 3 | E | E | G | F |
| EX. 4 | E | F | F | F |
| Ex. 5 | E | E | G | E |
| EX. 6 | E | E | G | E |
| Ex. 7 | E | G | G | G |
| EX. 8 | E | G | G | G |
| Comp. Ex. 1 | B | B | B | B |
| Comp. Ex. 2 | B | G | G | B |
| Comp. Ex. 3 | B | G | G | B |

The evaluation method of the development agent is as follows.

Low Temperature Fixing Property

After sequentially outputting 20,000 sheets on which a chart having an image area ratio of 3% is formed, images are formed at every 5° C. of the fixing roll to evaluate the low temperature fixing property. To be specific, after forming images such that the image density measures by X-Rite 938 is 1.2, the image is rubbed by a clock meter having a sand eraser ten times. The temperature at which the image density after rubbing is 70% or higher of the image density before rubbing is determined as the lowest fixing temperature.

The recording media used are type 6200 (manufactured by Ricoh Co., Ltd.) for full color PPC.

The evaluation criteria are as follows:

E (Excellent): the lowest fixing temperature 20° C. or more lower than that of a typical system (imagio MP C6000, manufactured by Ricoh Co., Ltd.)

G (Good): the lowest fixing temperature 10° C. to 20° C. lower than that of a typical system (imagio MP C6000, manufactured by Ricoh Co., Ltd.)

F (Fair): the lowest fixing temperature 0° C. to 10° C. lower than that of a typical system (imagio MP C6000, manufactured by Ricoh Co., Ltd.)

B (Bad): the lowest fixing temperature higher than that of a typical system (imagio MP C6000, manufactured by Ricoh Co., Ltd.)

High-Temperature Storage

After tapping a 20 ml glass container containing 10 g of the toner 100 times by a tapping device, the toner is preserved for 48 hours in a high temperature and high moisture environment (55° C., 80% RH), or in a low temperature and low moisture environment (15° C., 15% RH). Thereafter, the toner is subject to the penetration test by a penetration tester (manufactured by NIKKA ENGINEERING TOKYO JAPAN) according to its manual.

The high-temperature storage is evaluated as follows:

E (Excellent): smaller of the penetration value in the high temperature and high moisture environment and the penetration value in the low temperature and low moisture environment is 20 mm or more G (Good): smaller of the penetration value in the high temperature and high moisture environment and the penetration value in the low temperature and low moisture environment ranges from 15 mm to less than 20 mm F (Fair): smaller of the penetration value in the high temperature and high moisture environment and the penetration value in the low temperature and low moisture environment ranges from 10 mm to less than 15 mm B (Bad): smaller of the penetration value in the high temperature and high moisture environment and the penetration value in the low temperature and low moisture environment is less than 10 mm Development Stability The development stability is evaluated by measuring the change in the amount of charge of the toner using the blow-off method for 10,000 sheets sequentially output with an image area ratio of 3% and 60%.

To be specific, a development agent is placed in a Faraday gauge having a cylinder form with wire mesh on both ends, the toner is detached from the development agent by high pressurized air, and then the amount of charge remaining in the toner is measured by an electrometer.

Then, the mass of the toner is obtained from the weight difference of the Faraday gauge before and after blowing-off.

The development stability is evaluated as follows:

G (Good): Greater of variation in the amount of charge of the toner for the image area ratio of 3% and the variation in the amount of charge of the toner for the image area ratio of 60% is less than 5 μC/g F (Fair): Greater of variation in the amount of charge of the toner for the image area ratio of 3% and the variation in the amount of charge of the toner for the image area ratio of 60% is from 5 to less than 10 μC/g B (Bad): Greater of variation in the amount of charge of the toner for the image area ratio of 3% and the variation in the amount of charge of the toner for the image area ratio of 60% is 10 μC/g or higher.

Winding

After sequentially outputting 20,000 sheets on which a chart having an image ratio of 3% is formed, images are foamed at every 5° C. of the fixing roll to evaluate the winding around the fixing roll.

The recording media used are type 6200 (manufactured by Ricoh Co., Ltd.) for full color PPC. The evaluation criteria are as follows:

E (Excellent): Temperature at which winding occurs 20° C. or more higher than that of a typical system (imagio MP C6000, manufactured by Ricoh Co., Ltd.)

G (Good): Temperature at which winding occurs 10° C. to less than 20° C. higher than that of a typical system (imagio MP C6000, manufactured by Ricoh Co., Ltd.)

F (Fair): Temperature at which winding occurs 0° C. to less than 10° C. higher than that of a typical system (imagio MP C6000, manufactured by Ricoh Co., Ltd.)

B (Bad): Temperature at which winding occurs lower than that of a typical system (imagio MP C6000, manufactured by Ricoh Co., Ltd.)

This document claims priority and contains subject matter related to Japanese Patent Application no. 2009-246915 and 2009-253097, filed on Oct. 27, 2009, and Nov. 4, 2009, respectively, the entire contents of which are hereby incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

a mother toner particle having a core-shell structure formed of a core comprising a binder resin, a coloring agent, and an optional releasing agent, and a shell having a layer thickness of from 0.01 to 2.00 μm, the core having a softening index of from 60 to 85° C. as measured by a flow tester, and the shell having a thermal hardness of from 0.7 to 1.8; and an optional external additive.

2. The toner according to claim 1, wherein the shell is formed of resin particulates.

3. The toner according to claim 1, wherein the shell comprises a crystalline polyester.

4. The toner according to claim 1, wherein the mother particle is formed by emulsifying or dispersing in an aqueous medium a solution in which a toner material is dissolved or dispersed in an organic solvent.

5. The toner according to claim 4, wherein the toner material comprises a polyester prepolymer having an isocyanate group, and the mother toner particle is formed by conducting addition reaction of the polyester prepolymer and a compound having an amino group after emulsification or dispersion of the solution in the aqueous medium.

6. The toner according to claim 4, wherein the aqueous medium comprises resin particulates.

7. The toner according to claim 1, having an average circularity of from 0.93 to 0.99.

8. The toner according to claim 1, having a form factor SF-1 of from 100 to 150 and a form factor SF-2 of from 100 to 140.

9. The toner according to claim 1, having a weight average particle diameter of from 2 to 7 μm, and a ratio of the weight average particle diameter to a number average particle diameter of from 1.00 to 1.25.

10. A development agent, comprising:

the toner of claim 1; and a carrier.

11. An image formation method comprising:

forming a latent electrostatic image on an image bearing member;

developing the latent electrostatic image with the development agent of claim 10 to form a toner image;

transferring the toner image to a recording medium; and fixing the toner image transferred to the recording medium.

12. The image formation method according to claim 11, further comprising pressing the recording medium to which the toner image is transferred with a surface pressure of from 10 to 150 $N/cm^2$, wherein a system speed is from 500 to $2.5\times10^3$ mm/s.

13. The toner according to claim 3, wherein the crystalline polyester is synthesized from a monomer comprising an aliphatic diol.

14. The toner according to claim 3, wherein the crystalline polyester has a weight average molecular weight of from 2,000 to 18,000.

15. The toner according to claim 2, wherein the resin particulates comprise a resin synthesized from a composition comprising a polylactic acid.

16. The toner according to claim 2, wherein the resin particulates have a weight average molecular weight of from 3,000 to 70,000.

17. The toner according to claim 2, wherein the resin particulates have a particle diameter of from 176 nm to 1,130 nm.

* * * * *